US010074321B2

(12) United States Patent
de Greef

(10) Patent No.: US 10,074,321 B2
(45) Date of Patent: Sep. 11, 2018

(54) CONTROLLER AND METHODS FOR QUANTIZATION AND ERROR DIFFUSION IN AN ELECTROWETTING DISPLAY DEVICE

(71) Applicant: AMAZON TECHNOLOGIES, INC., Seattle, WA (US)

(72) Inventor: Petrus Maria de Greef, Waalre (NL)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 67 days.

(21) Appl. No.: 15/087,778

(22) Filed: Mar. 31, 2016

(65) Prior Publication Data

US 2017/0193926 A1 Jul. 6, 2017

Related U.S. Application Data

(60) Provisional application No. 62/275,113, filed on Jan. 5, 2016.

(51) Int. Cl.
*G09G 3/34* (2006.01)
*G09G 3/20* (2006.01)

(52) U.S. Cl.
CPC ..... *G09G 3/348* (2013.01); *G09G 3/2003* (2013.01); *G09G 2300/0452* (2013.01);
(Continued)

(58) Field of Classification Search
CPC ..... G09G 3/348; G09G 3/2003; G09G 5/02; G02B 26/00; G02B 26/005
See application file for complete search history.

(56) References Cited

U.S. PATENT DOCUMENTS 6,100,872 A * 8/2000 Aratani ..... G09G 3/3629 345/589
2008/0285084 A1* 11/2008 Takemura ..... H04N 1/40 358/3.03

(Continued)

FOREIGN PATENT DOCUMENTS

EP 2 388 773 A2 11/2011

OTHER PUBLICATIONS

International Search Report and Written Opinion from corresponding international application No. PCT/US2017/012124, 27 pgs., dated May 18, 2017.

(Continued)

*Primary Examiner* — Jennifer Mehmood
*Assistant Examiner* — Sardis F Azongha
(74) *Attorney, Agent, or Firm* — Brinks Gilson & Lione

(57) ABSTRACT

Systems and methods for driving an electrowetting display device including a plurality of sub-pixels are presented. A reflectance level of a first sub-pixel in the plurality of sub-pixels is set to a minimum reflectance level or a threshold reflectance level. A reflectance quantization error is determined and a second reflectance level of a second sub-pixel in the plurality of sub-pixels is set to a second target reflectance level of the second sub-pixel plus a first fraction of the reflectance quantization error. A third reflectance level of a third sub-pixel in the plurality of sub-pixels is set to a third target reflectance level of the third sub-pixel plus a second fraction of the reflectance quantization error, and a fourth reflectance level of a fourth sub-pixel in the plurality of sub-pixels is set to a fourth target reflectance level of the fourth sub-pixel plus a third fraction of the reflectance quantization error.

18 Claims, 15 Drawing Sheets

(52) U.S. Cl.
CPC . *G09G 2310/08* (2013.01); *G09G 2320/0626* (2013.01); *G09G 2330/021* (2013.01)

(56) References Cited

U.S. PATENT DOCUMENTS

| | | | | |
|---|---|---|---|---|
| 2008/0309953 | A1* | 12/2008 | Feng | G09G 3/2062 358/1.9 |
| 2010/0027073 | A1* | 2/2010 | Lin | G09G 3/344 358/3.03 |
| 2010/0165409 | A1* | 7/2010 | Tsukamoto | G09G 3/2044 358/3.01 |
| 2011/0285746 | A1* | 11/2011 | Swic | G09G 5/02 345/597 |
| 2012/0154423 | A1 | 6/2012 | Barnhoefer et al. | |
| 2012/0262774 | A1* | 10/2012 | Bae | G02B 26/005 359/290 |
| 2013/0215491 | A1* | 8/2013 | Choi | G02B 26/005 359/290 |
| 2014/0198126 | A1 | 7/2014 | Parmar et al. | |
| 2016/0335938 | A1* | 11/2016 | Bergquist | G09G 3/34 |

OTHER PUBLICATIONS

Communication Relating to the Results of the Partial International Search Report from corresponding international application No. PCT/US2017/012124, 7 pgs., dated Mar. 27, 2017.

Crocker et al., "Digital Halftoning", retrieved from the internet: URL:http://www.efg2.com/Lab/Library/ImageProcessing_/DHALF.txt, 4 pgs., retrieved Mar. 6, 2008.

International Preliminary Report on Patentability from corresponding international application No. PCT/US2017/012124, 18 pgs., Jul. 19, 2018.

* cited by examiner

CONTROLLER AND METHODS FOR QUANTIZATION AND ERROR DIFFUSION IN AN ELECTROWETTING DISPLAY DEVICE

CROSS-REFERENCE TO RELATED APPLICATIONS

This application claims priority to U.S. Provisional Patent Application 62/275,113 entitled "CONTROLLER AND METHODS FOR QUANTIZATION AND ERROR DIFFUSION IN AN ELECTROWETTING DISPLAY DEVICE" and filed on Jan. 5, 2016.

BACKGROUND

Many portable electronic devices include displays for displaying various types of images. Examples of such displays include electrowetting displays (EWDs), liquid crystal displays (LCDs), electrophoretic displays (EPDs), and light emitting diode displays (LED displays). In EWD applications, an addressing scheme is utilized to drive the pixel regions of the EWD. Generally, one point of emphasis for EWDs intended to be used in mobile and portable media devices is reducing power consumption while maintaining image quality.

An input video or data stream generally represents a sequence of display data values grouped per line; a sequence of lines grouped per frame; and a sequence of frames defining a frame sequence, such as a moving video stream (e.g., a movie). When such a video stream is to be reproduced on an active matrix EWD, a timing controller and one or more display drivers may be used to process the incoming data stream to control the pixel regions of the EWD. The purpose of an addressing scheme is to set and/or maintain the state of a pixel region. The addressing scheme drives an active matrix transistor array and provides analog voltages to individual pixel regions of the EWD. The pixel regions are grouped per row and when a row is addressed, voltages of a complete row are stored as charge on corresponding pixel region capacitors. As the display data is repeatedly updated, still and moving images are reproduced by the EWD.

BRIEF DESCRIPTION OF THE DRAWINGS

The detailed description includes reference to non-limiting and non-exhaustive embodiments illustrated in the accompanying figures. The same reference numerals in different figures refer to similar or identical items.

DETAILED DESCRIPTION

Figure 1A:
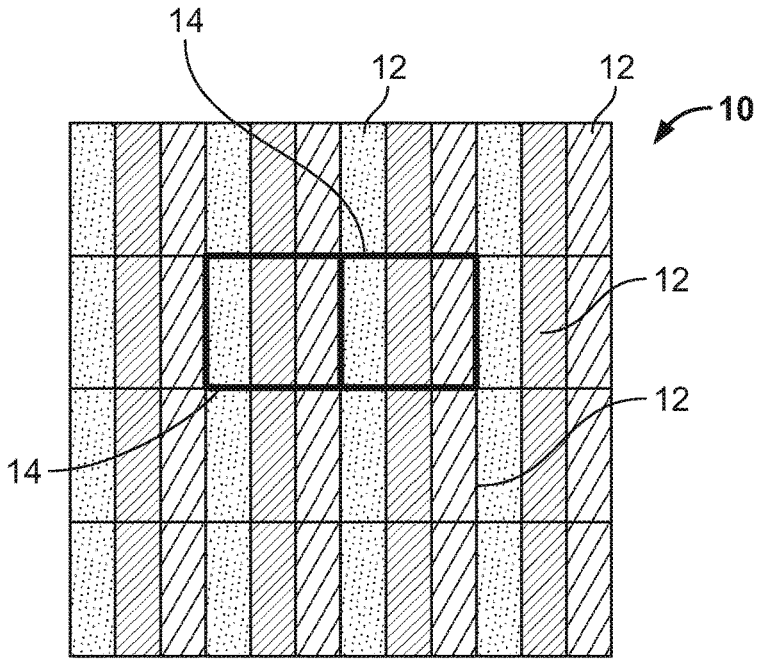
FIGS. 1A and 1B show example pixel layouts.

The present disclosure provides approaches to implement quantization and error diffusion for driving display devices, such as electrowetting display devices, based upon source image data. Within a display device, the opening and closing behavior of the sub-pixels of the device's pixels can make it difficult to set the sub-pixels to some brightness levels. For example, in reflective electrowetting display devices as described herein the opening and closing behavior of the sub-pixels can make it difficult to set the sub-pixels to certain reflectance levels—reflectance is a measure of the sub-pixel's capability to reflect or transmit light and determines the sub-pixel's apparent brightness. Accordingly, the present display device includes a controller, e.g., a timing controller, configured to use the source image data to identify target brightness levels, e.g., target reflectance levels, for the sub-pixels of the display device. The controller is then configured to quantize the target brightness levels, e.g., target reflectance levels to avoid difficult-to-achieve brightness levels, e.g., reflectance levels. The difference between the target brightness level, e.g., target reflectance level and the quantized brightness level, e.g., quantized reflectance level for a particular sub-pixel is referred to herein as error or quantization error. The controller then distributes the error to other sub-pixels in the display device by raising or lowering the brightness level, e.g., reflectance level, of the other sub-pixels to compensate for the change in brightness level, e.g., reflectance level, for the particular sub-pixel. While the display device in the example embodiments described herein is a reflective electrowetting display device having sub-pixels with reflectance levels, the systems and methods described herein may also be used with other display devices, such as transmissive display devices, for example, having sub-pixels with brightness levels.

A sub-pixel within a display device is associated with a number of pixel walls that surround or are otherwise associated with at least a portion of the sub-pixel. The sub-pixel walls form a structure that is configured to contain at least a portion of a first liquid, such as an opaque oil. Light transmission through the sub-pixel can be controlled by an application of an electric potential to the sub-pixel, which results in a movement of a second liquid, such as an electrolyte solution, into or within the sub-pixel, thereby displacing the first liquid.

When the sub-pixel is in a rest state (i.e., with no electric potential applied), the opaque oil is distributed throughout the sub-pixel. The oil absorbs light and the sub-pixel in this condition appears black. But when the electric potential is applied, the oil is displaced. Light can then enter the sub-pixel striking a reflective surface. The light then reflects out of the sub-pixel, causing the sub-pixel to appear white to an observer. If the reflective surface only reflects a portion of the light spectrum or if light filters are incorporated into the sub-pixel structure, the sub-pixel may appear to have color. Within a display, sub-pixels that are configured to reflect or transmit light of different colors are grouped together into pixels. For example, a particular pixel may include sub-pixels configured to reflect red, green, blue, and white light. By adjusting the position of the fluids within the pixel's different sub-pixels, the color and brightness of light reflected by the pixel can be controlled.

The degree to which the oil is displaced from its resting position affects the overall reflectance or brightness of a sub-pixel and, thereby, the sub-pixel's appearance. In an optimal display device, the driving voltage for a particular sub-pixel results in a predictable fluid movement and, thereby, a predictable reflectance level for that sub-pixel, enabling the overall reflectance of the display device to be precisely and predictably controlled. In real world implementations, however, when a sub-pixel is driven at a particular driving voltage, the resulting reflectance for that sub-pixel depends upon the state of the sub-pixel before the driving voltage was applied. If, for example, the sub-pixel was already open when driven at the driving voltage, the resulting reflectance may be different than if the sub-pixel was closed before the driving voltage was applied.

Accordingly, the fluid movement within a sub-pixel exhibits hysteresis, making fluid position difficult to accurately predict based solely upon driving voltage. This attribute of electrowetting display sub-pixels consequently makes reflectance difficult to control, resulting in potential degradations in overall image quality and/or image artifacts. The disclosed system and methods, therefore, implement quantization and error diffusion techniques to minimize or reduce sub-pixel reflectance uncertainty resulting from oil movement hysteresis.

In at least some conventional color displays, device pixels include red, green, and blue (RGB) sub-pixels to render colors, as presented by standard input image-data or video-data. In some cases, the pixel may include a white (W) pixel region to reproduce image-data, in order to improve the brightness and the efficiency of color rendering. The white sub-pixel region can be implemented as an extra sub-pixel in addition to a red sub-pixel, a green sub-pixel and a blue sub-pixel or, alternatively, as a part of the RGB pixel, referred to herein as "in-cell-white" sub-pixel. In various embodiments, red light may include electromagnetic radiation having wavelengths ranging from 620 nm to 750 nm, green light may include electromagnetic radiation having wavelengths ranging from 495 nm to 570 nm, and blue light may include electromagnetic radiation having wavelengths ranging from 450 nm to 495 nm.

FIG. 1A shows an example pixel layout 10 including only red, green, and blue sub-pixels 12. In this configuration, the different color sub-pixels 12 are arranged together in a column or "stripe" within the pixel layout. Sub-pixels 12 are grouped together into pixels 14, where each pixel 14 may include a red, green, and blue sub-pixel 12.

Figure 1B:
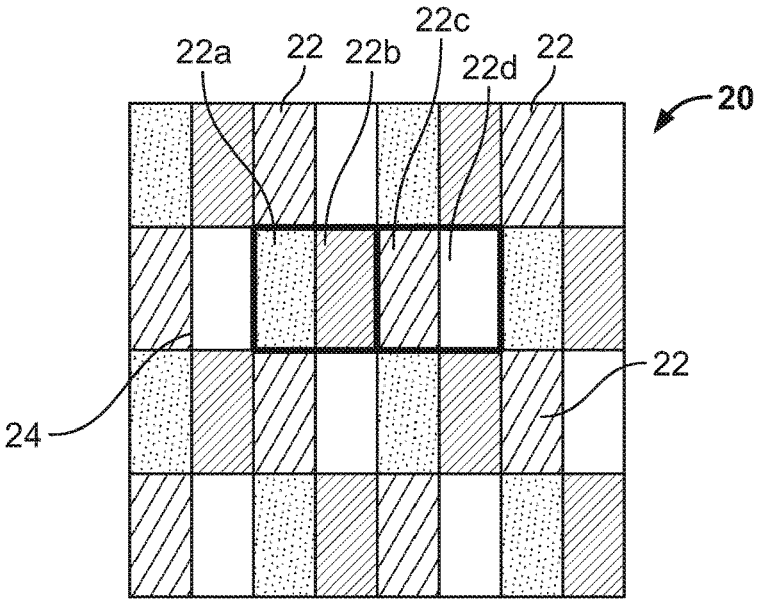

FIG. 1B shows another example pixel layout 20 that includes red, green, blue and white sub-pixels 22. In this configuration, two sub-pixels 22 are grouped together into a pixel 24. More specifically, in this configuration, a red sub-pixel 22*a* and a green sub-pixel 22*b* are grouped together into a first pixel 24*a*, and a blue sub-pixel 22*c* and a white sub-pixel 22*d* are grouped together into a second pixel 24*b*.

Generally, a display device creates an image by first receiving source image data. The source image data specifies color and brightness levels for a large number of locations (referred to as pixels) in the source image. That source image data is then analyzed to determine appropriate driving levels (e.g., reflectance levels) for the pixels and sub-pixels of the display device in order to most accurately re-create that source image data on the screen of the display device. Sometimes this requires some translation of the source image data into a format more suited to the physical constraints of the display device. For example, source image data having a relatively high resolution in space and an 8 bit RGB resolution in brightness and color, coded according to the sRGB standard, may need to be reproduced on a 6 bit RGBW physical display. The display device therefore converts the information contained within the input image data to corresponding reflectance or brightness levels for the red, green, blue, and white sub-pixels within the display device. By setting the sub-pixels of the display device accordingly, a reproduction of the image specified in the source image data can be generated by the display device.

Figure 2:
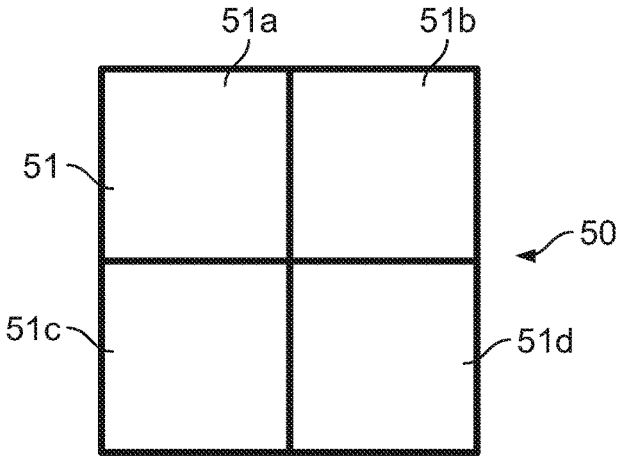
FIG. 2 is an illustration showing the translation of source image data into pixel state data for a display device.
Figure 2:
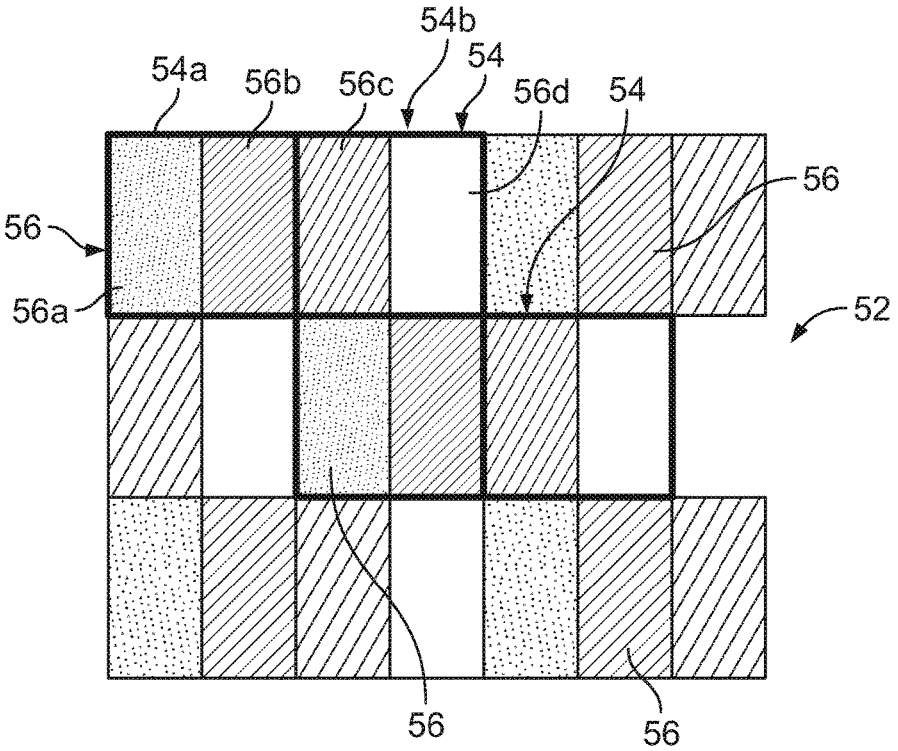

FIG. 2 is an illustration depicting the translation of source image data into RGBW pixel state data—data that specifies reflectance levels for each sub-pixel in the RGBW pixels—for the display device. In FIG. 2, source image data 50 specifies image data for four source image pixels 51, for example, 51*a*, 51*b*, 51*c*, and 51*d* (in a real-world example, the source image data would include data for many more image pixels). Each source image pixel 51 has a location within the source image as defined by the coordinates associated with each source image pixel 51. As shown in FIG. 2, source image data 50 specifies image data for a first source image pixel 51*a* located in a first row and a first column, a second source image pixel 51*b* located in a first row and a second column, a third source image pixel 51*c* located under first source image pixel 51*a* in a second row and a first column, and a fourth source image pixel 51*d* located under second source image pixel 51*b* in a second row and a second column, for example. A combination, i.e., a tuple, of a red (R) value, a green (G) value, and a blue (B) value specified for each source image pixel 51 within image data 50 describes a particular color and brightness. The display device receives source image data 50 and maps each source image pixel 51 within image data 50 to a pixel array 52 of the display device having a plurality of pixels 54. Each pixel 54 includes a group of sub-pixels. More specifically, in this configuration, a red sub-pixel 56*a* and a green sub-pixel 56*b* are grouped together in a first pixel 54*a*, and a blue sub-pixel 56*c* and a white sub-pixel 56*d* are grouped together in a second pixel 54*b* adjacent first pixel 54*a*. The display device then translates the tuple for a particular source image pixel 51 in source image data 50 into reflectance levels for each sub-pixel 56 in one or more corresponding pixels 54 of pixel array 52, as described in the example embodiments. In certain examples, the tuple for a particular source image pixel 51 in source image data 50 will be input as data for driving sub-pixels within two or more corresponding pixels 54 of pixel array 52. When the sub-pixels 56 in the corresponding pixels 54 are set to those reflectance levels, an observer's eye combines the outputs of the various sub-pixels 56 into the corresponding color and brightness specified in the corresponding source image pixel 51 of source image data 50.

The pixel configuration illustrated by pixel array 52 is, in one example, a PENTILE structure and, specifically, a PENTILE L6W pixel configuration. In such an arrangement, the groups of sub-pixels are arranged in a square pixel grid at a physical pitch, with each sub-pixel covering an area representing a primary color at a defined brightness. Electrowetting displays are typically used in reflective mode. In bright ambient conditions, the electrowetting displays may reflect a lot of light, yet in dark ambient conditions their brightness is limited and a front-light can be used to expose the pixel region of the electrowetting display with additional light. In bright ambient conditions, the front-light may have no or minimal impact. It can be dimmed or turned off, to save energy. An ambient light sensor can be used to measure the ambient light condition, to be used as input for a control unit which controls the front-light. Reflective EWDs may include a diffusing layer on top of the EWD panel, acting as a spatial low-pass filter, in order to improve the viewing angle.

Although in the following disclosure, embodiments of an example electrowetting display device having an electrowetting display (EWD) are described and shown, the schemes and techniques are suitable for use with other displays including, without limitation, liquid crystal displays (LCDs), electrophoretic displays (EPDs), light-emitting diode displays (LED displays), organic light-emitting diode displays (OLED displays), and plasma displays. The display device includes a pixel region, one or more pixels each including one or more sub-pixels, or one or more sub-pixels of an electrowetting display device. Such an electrowetting element, pixel or sub-pixel may be the smallest light transmissive, reflective or transflective component of an electrowetting display that is individually operable to directly control an amount of light transmission through and/or reflection from the pixel region. For example, in some implementations, a pixel region may include a pixel having a red sub-pixel, a green sub-pixel, a blue sub-pixel, and a white sub-pixel. In other implementations, a pixel region may include a pixel having only a white sub-pixel as part of a mono color electrowetting display.

In general, electronic display devices including, without limitation, portable computing devices, tablet computers, laptop computers, notebook computers, mobile phones, personal digital assistants (PDAs), and portable media devices (e.g., e-book devices and DVD players), display images on a display. Such displays may include, for example, EWDs, LCDs, EPDs, and LED displays.

More particularly, an electronic display device, such as an electrowetting display device, includes a thin film transistor electrowetting display (TFT-EWD) having an array of transmissive, reflective or transflective pixel regions configured to be operated by an active matrix addressing scheme. A pixel region may, unless otherwise specified, include an electrowetting element, one or more pixels, one or more pixels each including a plurality of sub-pixels, or one or more sub-pixels of an electrowetting display device. For example, rows and columns of pixels, e.g., pixels or sub-pixels, are operated by controlling voltage levels on a plurality of source lines and a plurality of gate lines. In this fashion, the electronic display device can produce an image by selecting particular pixels to transmit, reflect or block light. Pixels are addressed (e.g., selected) via source lines and gate lines that are connected to corresponding transistors (e.g., used as switches) associated with the pixel. In certain embodiments, these transistors take up a relatively small fraction of the area of each pixel. For example, in certain embodiments, the transistor is located underneath the reflector in reflective displays.

An electrowetting display employs an applied voltage (e.g., a driving voltage or drive voltage) to change the surface tension of a liquid in relation to a surface. For instance, by applying a voltage to a hydrophobic surface via a pixel region electrode in conjunction with a common electrode, the wetting properties of the surface can be modified so that the surface becomes increasingly hydrophilic. In general, the term "hydrophobic" refers to the ability of a material or surface to repel water or polar fluids, while the term "hydrophilic" generally refers to a material or surface having an affinity for water or polar fluids. As one example of an electrowetting display, a voltage is applied to the display to modify a surface tension within one or more pixels causing an electrowetting liquid in the individual pixels of the display to adjoin the modified surface and, thus, replace a colored electrowetting oil layer in the individual pixels of the display. The electrowetting fluids in the individual pixels of the display respond to the change in surface tension and act as an optical switch. When the voltage is absent, the colored electrowetting oil forms a continuous film on the hydrophobic surface within a pixel, and the color may thus be visible to a user of the display. On the other hand, when the voltage is applied to the pixel region, the colored electrowetting oil is displaced and the pixel becomes transparent. When multiple pixels of the display are independently activated, the display can present a color or grayscale image. The pixels may form the basis for a transmissive, reflective, or transmissive/reflective (transreflective) display. Further, the pixels may be responsive to high switching speeds (e.g., on the order of several milliseconds), while employing small pixel dimensions. Accordingly, the electrowetting displays described herein may be suitable for applications such as displaying video content. In addition, the low power consumption of electrowetting displays in general makes the technology suitable for displaying content on portable display devices that rely on battery power.

Generally, a dedicated gate scanning algorithm is implemented to drive electrowetting displays. The image quality perceived by a viewer of the electrowetting display can be affected by brightness or reflectance variations of the electrowetting display due to leakage (voltage leakage from storage capacitors of the pixel regions of the electrowetting display), backflow (fluid movement within the pixel regions of the electrowetting display) and reset pulses (resetting of pixel regions within the electrowetting display). The brightness variations depend on physical properties of the electrowetting display, as well as the input frame rate from the image source, the repeat rate for mitigating leakage, the refresh rate for mitigating backflow, and the reset pulse intensity.

Figure 3:
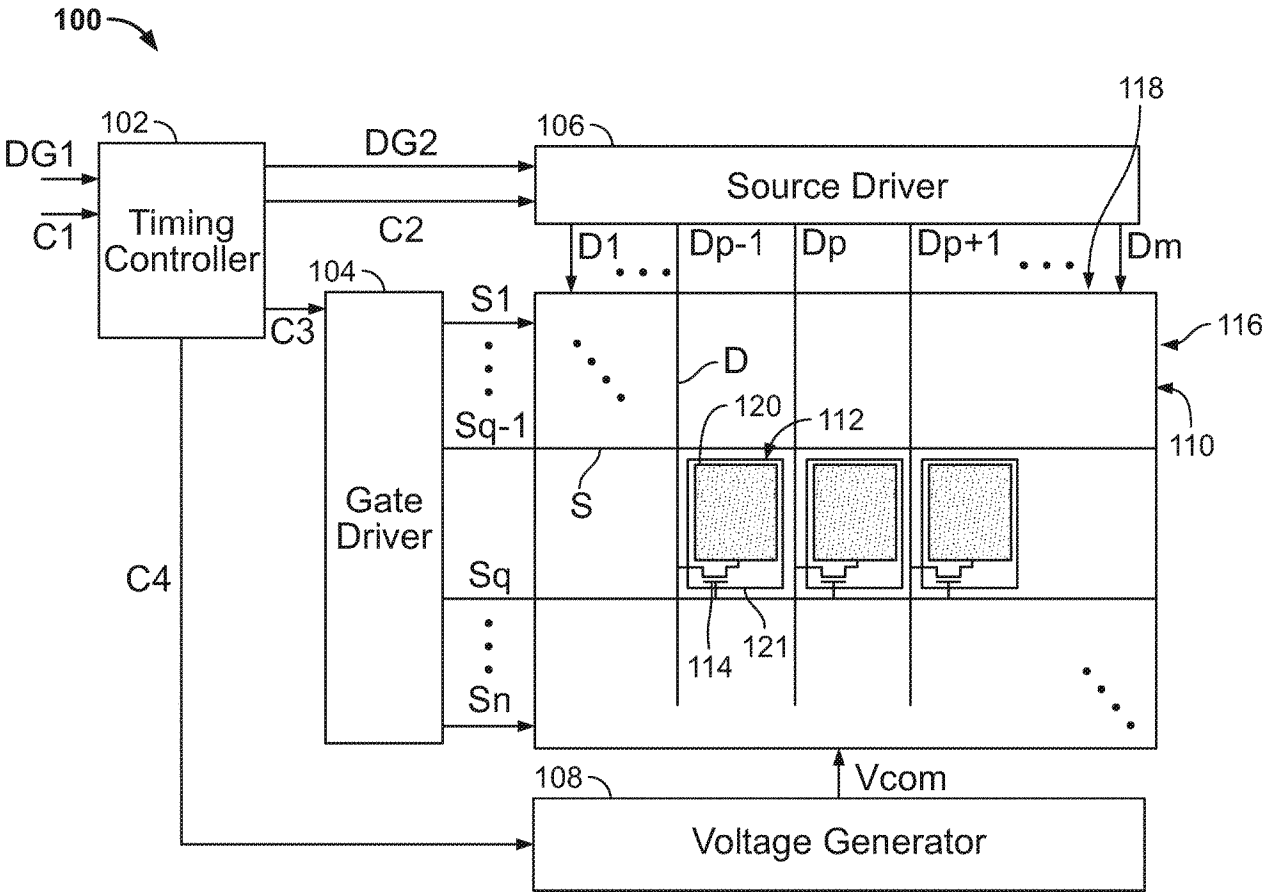
FIG. 3 is a schematic view of an example electrowetting display device, according to various embodiments.

Referring to FIG. 3, an example electrowetting display 100 is schematically illustrated. Electrowetting display 100 includes a timing controller 102, a gate or row driver (scan driver) 104, a source or column driver (data driver) 106, a voltage generator 108, and an electrowetting display panel 110. Electrowetting display panel 110 is driven by timing controller 102, gate driver 104, source driver 106 and voltage generator 108.

As an example of general operation of electrowetting display 100, in one embodiment, responsive to a first data signal DG1 and a first control signal C1 from an external image source, e.g., a graphic controller (not shown in FIG.

3), timing controller 102 transmits a second data signal DG2 and a second control signal C2 to source driver 106, a third control signal C3 to gate driver 104, and a fourth control signal C4 to voltage generator 108. Electrowetting display panel 110 includes m data lines D, i.e., source lines, to transmit the data voltages and n gate lines S, i.e., scan lines, to transmit a gate-on signal to TFTs 114 to control pixel regions 112. Thus, timing controller 102 controls gate driver 104 and source driver 106. Timing controller 102 transmits second data signal DG2 and a second control signal C2 to source driver 106, third control signal C3 to gate driver 104, and fourth control signal C4 to voltage generator 108 to drive pixel regions 112. Gate driver 104 sequentially transmits scan signals S1, . . . , Sq−1, Sq, . . . Sn to electrowetting display panel 110 in response to third control signal C3 to activate rows of pixel regions 112 via the gates of TFTs 114. Source driver 106 converts second data signal DG2 to voltages, i.e., data signals, and transmits the data signals D1, . . . , Dp−1, Dp, Dp+1, . . . , Dm to sources of TFTs 114 of pixel regions 112 within an activated row of pixel regions 112 to thereby activate (or leave inactive) pixel regions 112.

Source driver 106 converts second data signal DG2 to voltages, i.e., data signals, and applies the data signals D1, . . . , Dp−1, Dp, Dp+1, . . . , Dm to electrowetting display panel 110. Gate driver 104 sequentially transmits scan signals S1, . . . , Sq−1, Sq, . . . , Sn to electrowetting display panel 110 in response to third control signal C3. Voltage generator 108 applies a common voltage Vcom to electrowetting display panel 110 in response to fourth control signal C4. Although not illustrated in FIG. 3, voltage generator 108 generates various voltages required by timing controller 102, gate driver 104, and source driver 106.

A plurality of pixel regions 112 are positioned adjacent to crossing points of the data lines D and the gate lines S and, thus, are arranged in a grid having a plurality of rows of pixel regions referred to herein as rows 116 and a plurality of columns of pixel regions referred to herein as columns 118. Each pixel region 112 includes a hydrophobic surface (not illustrated in FIG. 3), a thin film transistor (TFT) 114, and a pixel region electrode 120 under the hydrophobic surface. Each pixel region 112 may also include a storage capacitor (not illustrated) under the hydrophobic surface. A plurality of intersecting partition walls 121 separates pixel regions 112. Pixel regions 112 can represent, for example, pixels within electrowetting display 100 or sub-pixels within electrowetting display 100, depending on the application for electrowetting display 100.

Figure 4:
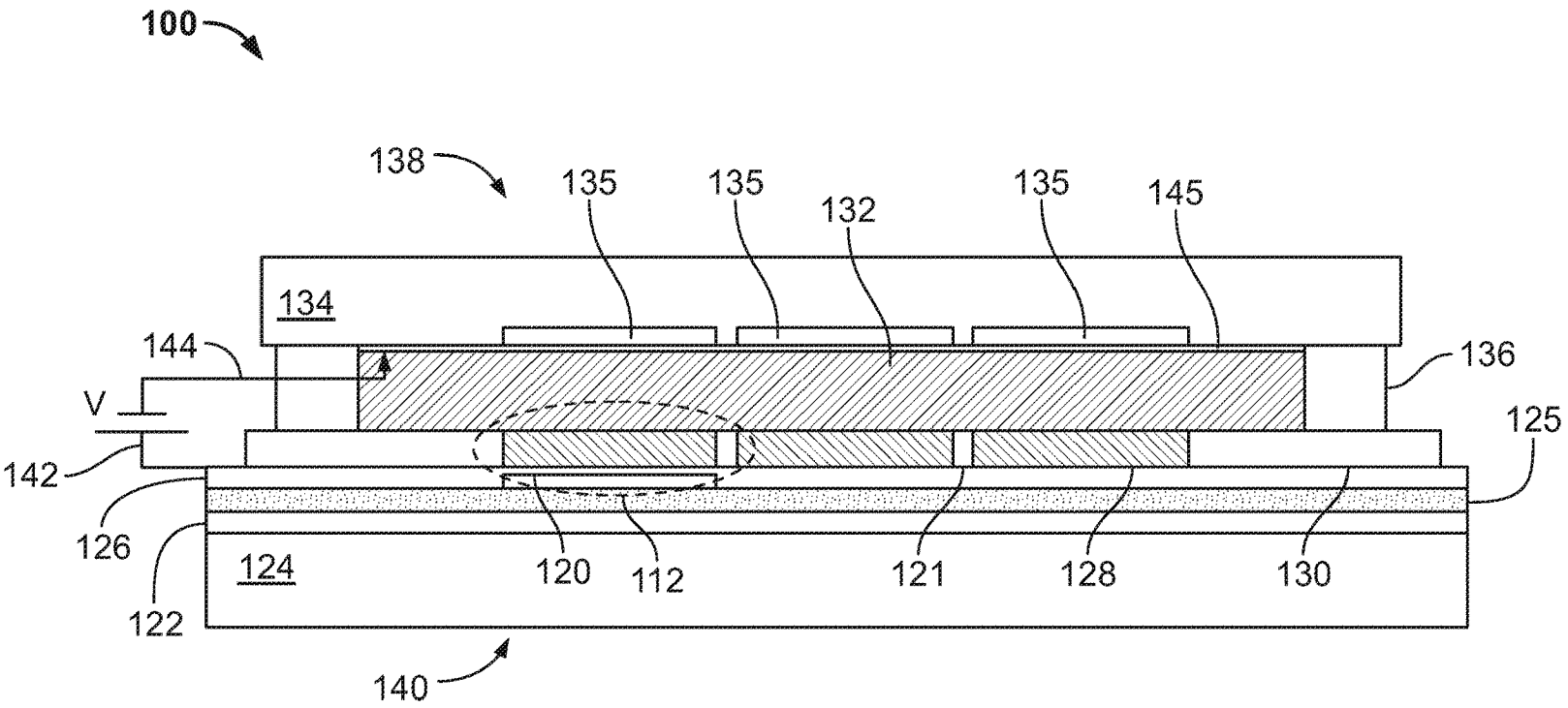
FIG. 4 is a cross-section view of a portion of the electrowetting display device of FIG. 1, according to various embodiments.

FIG. 4 is a cross-section view of a portion of electrowetting device 100 showing several pixel regions 112, which may include pixels or sub-pixels, according to various embodiments. An electrode layer 122 that includes pixel region electrodes 120 is formed on a first or bottom support plate 124. Thus, electrode layer 122 is generally divided into portions that serve as pixel region electrodes 120.

In some implementations, a dielectric barrier layer 125 may at least partially separate electrode layer 122 from a hydrophobic layer 126 also formed over electrode layer 122. While optional, dielectric barrier layer 125 may act as a barrier that prevents electrolyte components (e.g., an electrolyte solution) from reaching electrode layer 122. In certain embodiments, dielectric barrier layer 125 includes a silicon dioxide layer (e.g., having a thickness of about 0.2 microns) and a polyimide layer (e.g., having a thickness of about 0.1 micron), though claimed subject matter is not so limited. In some implementations, hydrophobic layer 126 includes a fluoropolymer resin, such as, for example, Teflon® AF1600, produced by DuPont, based in Wilmington, Del.

Pixel walls 121 form a patterned pixel region grid on hydrophobic layer 126, as shown in FIG. 3. In one embodiment, pixel walls 121 include a photoresist material, such as, for example, an epoxy-based negative photoresist SU-8. As described above, the patterned pixel region grid includes a plurality of pixel regions 112 arranged in a plurality of rows 116 and a plurality of columns 118 that form a pixel region array (e.g., electrowetting display panel 110). For example, in certain embodiments, pixel region 112 can have a width and a length in a range of about 50 microns to 500 microns. A first fluid 128, e.g., a liquid, which in certain embodiments has a thickness of 1 micron to 10 microns, for example, overlies hydrophobic layer 126. First fluid 128 is electrically non-conductive, e.g., an opaque oil retained in the individual electrowetting pixel regions 112 by pixel walls 121 of the patterned pixel region grid. An outer rim 130 may include the same material as pixel walls 121.

A second fluid 132, e.g., a liquid, overlies first fluid 128 and pixel walls 121 of the patterned pixel region grid. In certain embodiments, second fluid 132 is an electrolyte fluid or solution that is electrically conductive or polar and may be a water or a salt solution, such as a solution of potassium chloride in water. Second fluid 132 may be transparent, but may be colored, or light-absorbing. Second fluid 132 is immiscible with first fluid 128. In general, substances are immiscible with one another if the substances do not substantially form a solution, although in a particular embodiment second fluid 132 might not be perfectly immiscible with first fluid 128. In general, an "opaque" fluid is a fluid that appears black to an observer. For example, an opaque fluid strongly absorbs a broad spectrum of wavelengths (e.g., including those of red, green and blue light) in the visible region of electromagnetic radiation appearing black. However, in certain embodiments an opaque fluid may absorb a relatively narrower spectrum of wavelengths in the visible region of electromagnetic radiation and may not appear perfectly black.

In some embodiments, the opaque fluid is a nonpolar electrowetting oil. In certain embodiments, first fluid 128 may absorb at least a portion of the visible light spectrum. First fluid 128 may be transmissive for a portion of the visible light spectrum, forming a color filter. For this purpose, first fluid 128 may be colored by addition of pigment particles or a dye. Alternatively, first fluid 128 may be black, for example by absorbing substantially all portions of the visible light spectrum, or reflecting. A reflective first fluid 128 may reflect the entire visible light spectrum, making the layer appear white, or a portion of the entire visible light spectrum, making the layer have a color. In example embodiments, first fluid 128 is black and, therefore, absorbs substantially all portions of an optical light spectrum, for example, in the visible light spectrum. In other embodiments, color filters 135 may be positioned over pixel regions 112 so that light reflecting out of the pixel region 112 takes on the color of that pixel region 112's color filter 135. In some embodiments, color filters 135 may be constructed from similar materials (and using similar manufacturing procedures) to those of pixel walls 121.

Hydrophobic layer 126 is arranged on bottom support plate 124 to create an electrowetting surface area. The hydrophobic character causes first fluid 128 to adjoin preferentially to bottom support plate 124 because first fluid 128 has a higher wettability with respect to the surface of hydrophobic layer 126 than second fluid 132. Wettability relates to the relative affinity of a fluid for the surface of a solid. Wettability increases with increasing affinity, and it can be measured by the contact angle formed between the fluid and the solid and measured internal to the fluid of interest. For example, such a contact angle can increase from relative non-wettability of more than 90° to complete wettability at 0°, in which case the fluid tends to form a film on the surface of the solid.

A second or top support plate 134 is opposite bottom support plate 124 to cover edge seals 136 and retain first fluid 128 and second fluid 132 over the pixel region array. Bottom support plate 124 and top support plate 134 may be separate parts of individual pixel regions 112 or bottom support plate 124 and top support plate 134 may be shared by a plurality of pixel regions 112. Bottom support plate 124 and top support plate 134 may be made of a suitable glass or polymer material and may be rigid or flexible, for example.

A voltage V (e.g., a drive voltage or driving voltage) applied across second fluid 132 and the dielectric barrier layer stack (e.g., hydrophobic layer 126) of individual pixel regions 112 can control transmittance or reflectance of the individual pixel regions 112. More particularly, in certain embodiments, electrowetting display 100 may be a transmissive, reflective or transflective display that generally includes an array of pixel regions 112, as shown in FIG. 3, configured to be operated by an active matrix addressing scheme. For example, rows 116 and columns 118 of pixel regions 112 are operated by controlling voltage levels on a plurality of source lines (e.g., source lines D of FIG. 3) and gate lines (e.g., gate lines S of FIG. 3). In this fashion, electrowetting display 100 may produce an image by selecting particular pixel regions 112 to at least partly transmit, reflect or block light.

Electrowetting display device 100 has a viewing side 138 on which an image formed by electrowetting display device 100 can be viewed, and an opposite rear side 140. In an example embodiment, top support plate 134 faces viewing side 138 and bottom support plate 124 faces rear side 140. In this embodiment, top support plate 134 is coupled to bottom support plate 124 with an adhesive or sealing material 136. In an alternative embodiment, electrowetting display device 100 may be viewed from rear side 140. Electrowetting display device 100 may be a reflective, transmissive or transreflective type. Electrowetting display device 100 may be a segmented display type in which the image is built up of segments. The segments can be switched simultaneously or separately. Each segment includes one pixel region 112 or a number of pixel regions 112 that may be neighboring or distant from one another. Pixel regions 112 included in one segment can be switched simultaneously, for example. Electrowetting display device 100 may also be an active matrix driven display type or a passive matrix driven display, for example.

Referring to FIG. 4, electrode layer 122 is separated from first fluid 128 and second fluid 132 by an insulator, which may be hydrophobic layer 126. Electrode layer 122 (and thereby pixel region electrodes 120) is supplied with voltage signals V by a first signal line 142. A second signal line 144 is electrically connected to a top electrode 145 that is in contact with the conductive second fluid 132. This top electrode may be common to more than one pixel region 112 because pixel regions 112 are in fluid communication with and may share second fluid 132 uninterrupted by pixel walls 121. Pixel regions 112 are controlled by the voltage V applied between first signal line 142 and second signal line 144.

First fluid 128 absorbs at least a part of the optical spectrum. First fluid 128 may be transmissive for a part of the optical spectrum, forming a color filter. For this purpose, first fluid 128 may be colored by addition of pigment particles or dye, for example. Alternatively, first fluid 128 may be black (e.g., absorbing substantially all parts of the optical spectrum) or reflecting. Hydrophobic layer 126 may be transparent. A reflective layer positioned under hydrophobic layer 126 may reflect the entire visible light spectrum, making the layer appear white, or reflect a portion of the visible light spectrum, making the layer have a color.

When the voltage V applied between first signal line 142 and second signal line 144 is set at a non-zero active signal level, pixel region 112 will enter into an active state or open state. Electrostatic forces will move second fluid 132 toward electrode layer 122, thereby displacing first fluid 128 from the area of hydrophobic layer 126 towards, for example, pixel wall 121 surrounding the area of hydrophobic layer 126, to a droplet-like shape. This action uncovers at least part of first fluid 128 from the surface of hydrophobic layer 126 of pixel region 112 thereby opening the pixel region 112. When the voltage across pixel region 112 is returned to an inactive signal level of zero volts or a value near to zero volts, pixel region 112 will return to an inactive or closed state, and first fluid 128 flows back to cover hydrophobic layer 126. In this way, first fluid 128 forms an electrically controllable optical switch in each pixel region 112.

Generally, thin film transistor 114 includes a gate electrode that is coupled to, such as electrically connected to, a corresponding scan line of the scan lines S, a source electrode that is coupled to, such as electrically connected to, a corresponding data line of the data lines D, and a drain electrode that is coupled to, such as electrically connected to, pixel region electrode 120. Thus, pixel regions 112 are operated, i.e., by driving electrowetting display 100, based on the scan lines S and the data lines D as shown in FIG. 3.

For driving electrowetting displays via the scan lines S and the data lines D, a dedicated gate scanning algorithm may generally be implemented. The gate scanning algorithm generally defines an address timing for addressing rows of pixel regions 112. Within each input frame, each row 116 (corresponding to the scan lines S) of pixel regions 112 within electrowetting display 100 generally needs to be written to twice. On occasion, the amount of writing can be more, depending on the actual drive scheme implementation. In general, the first write action discharges pixel region 112 to a reset level, e.g., a black level voltage, which is also referred to as a reset of pixel region 112. The second write action generally charges pixel region 112 to an actual required display data value. Often, pixel regions 112 may need to be refreshed to maintain their appearance when the corresponding data value for a particular pixel region 112 does not change. This is especially true when electrowetting display 100 is displaying a still image when all of pixel regions 112 may need to be refreshed. A refresh sequence generally involves a reset sequence followed by a repeat sequence, which recharges pixel regions 112 with their display data values.

Figure 5:
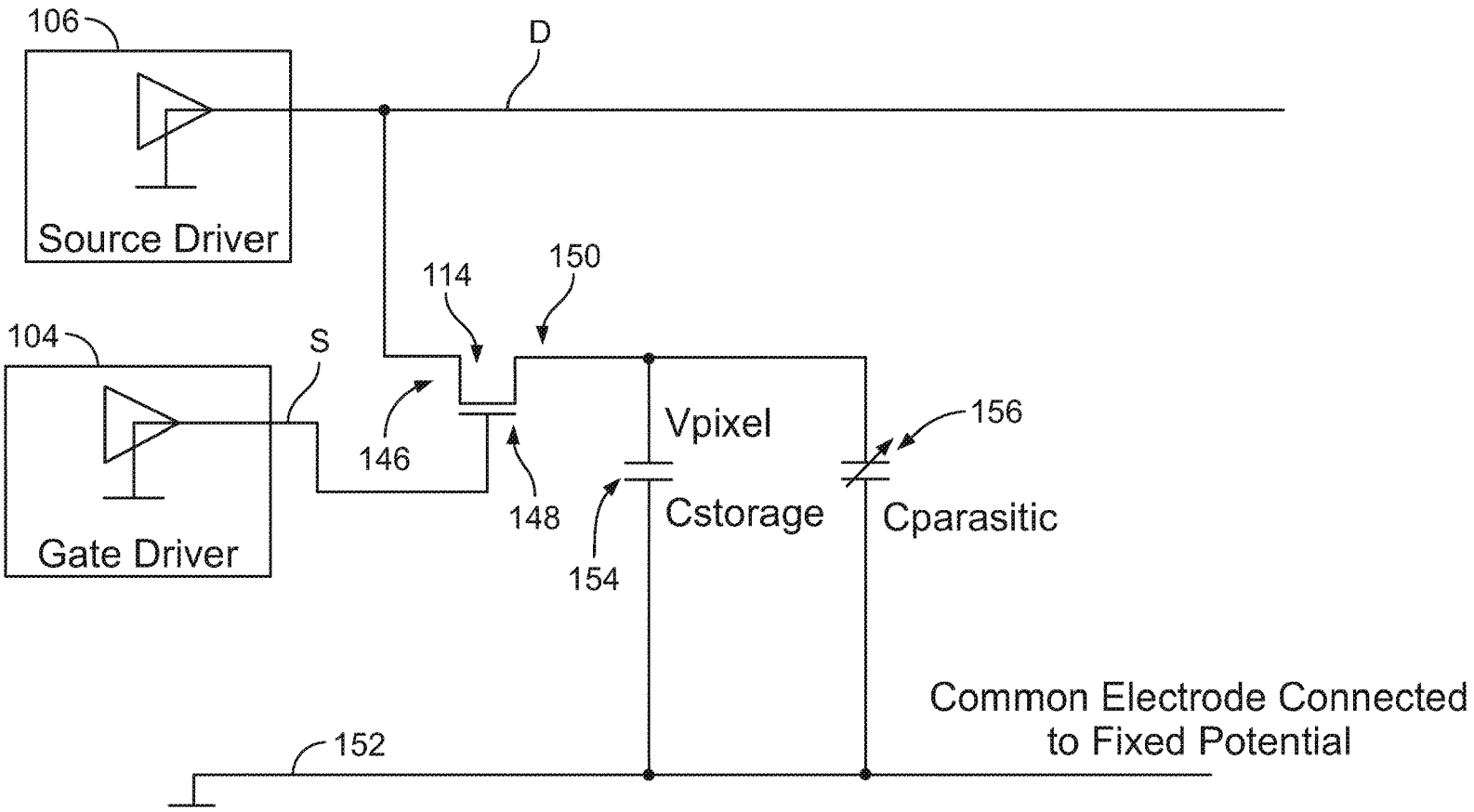
FIG. 5 is a schematic view representing example circuitry for pixel regions within the electrowetting display of FIGS. 3 and 4, according to various embodiments.

FIG. 5 schematically illustrates an arrangement of thin film transistor (TFT) 114 for pixel region 112 within electrowetting display 100. Each pixel region 112 within electrowetting display 100 generally includes such an arrangement. Source driver 106 is coupled to a data line D. The data line D is coupled to a source 146 of TFT 114 for pixel region 112. A scan line S is coupled to a gate 148 of TFT 114. The scan line S is coupled to gate driver 104. A drain 150 of TFT 114 is coupled to a common line 152 that is coupled to a fixed potential of a common electrode (not shown in FIG. 5) within electrowetting display 100. Common line 152 is also coupled to ground. A storage capacitor 154 ("Cstorage"), is provided between TFT 114 and common line 152. A variable parasitic capacitor 156, ("Cparasitic"), representing a variable parasitic capacitance, is present in each pixel region 112 between drain 150 of TFT 114 and common line 152.

Figure 6:
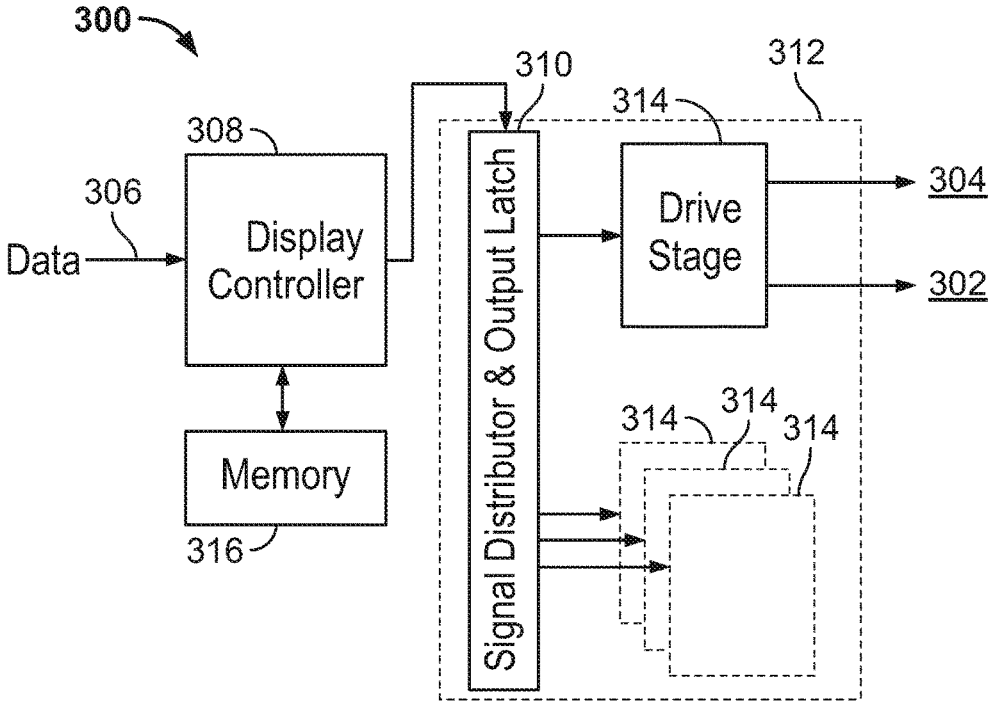
FIG. 6 is a schematic view of a simplified arrangement for a portion of an example electrowetting display device, according to various embodiments.

FIG. 6 shows a block diagram of an example embodiment of an electrowetting display driving system 300, including a control system of the display device. Display driving system 300 can be of the so-called direct drive type and may be in the form of an integrated circuit adhered to bottom support plate 124. Display driving system 300 includes control logic and switching logic, and is connected to the display by means of electrode signal lines 302 and a common signal line 304. Each electrode signal line 302 connects an output from display driving system 300 to a different electrode within each sub-pixel (not shown), respectively. Common signal line 304 is connected to second fluid 132 through an electrode. Also included are one or more input data lines 306, whereby display driving system 300 can be instructed with data so as to determine which sub-pixels should be in an active or open state and which sub-pixels should be in an inactive or closed state at any moment of time. In this manner, display driving system 300 can determine a target reflectance level for each sub-pixel within the display. The data specifying the target reflectance level for each sub-pixel may explicitly set forth a particular reflectance level or, in some embodiments, may include data from which a target reflectance level or driving voltage can be determined. For example, the data may specify a particular percentage by which a particular sub-pixel should be opened, or a particular driving voltage for the sub-pixel. The data may also specify a particular brightness or color for a sub-pixel or any other data indicating how a particular sub-pixel within the display device should appear. A controller 308 can then convert (if necessary) that data into target reflectance levels for each sub-pixel. Once a target reflectance level is determined for a particular sub-pixel, controller 308 sets the reflectance level of the sub-pixel to that target reflectance level by converting the reflectance level into a corresponding driving voltage to be subjected to the electrode of the sub-pixel. That driving voltage is then applied to the appropriate electrode signal line 302. In some embodiments, the driving voltage values are determined by display drivers in communication with controller 308.

In the present disclosure, the reflectance level of a particular sub-pixel may relate to or provide some indication of the actual reflectance of the sub-pixel. The reflectance level is not necessarily a measure of the sub-pixel's actual reflectance, but is a value that is intended to scale with or relate to the sub-pixel's actual reflectance. The reflectance level may be expressed as a numerical value utilized by display driving system 300 to select an appropriate driving voltage for a sub-pixel. Reflectance levels, for example, may include numerical values between 0 and 255, where 0 represents a minimum reflectance of a pixel and 255 represents a maximum reflectance. In other embodiments, such a scale may include more or fewer values. In other cases, the reflectance level may be a numerical value equal to or easily translated into a corresponding driving voltage, such as an actual voltage value, a scaled voltage value, a video level, or other similar values.

In the present disclosure, various embodiments of electrowetting sub-pixel driving and error diffusion schemes are presented that analyze the current state of a sub-pixel, as well as that sub-pixel's current and target reflectance level to make decisions regarding the reflectance level to which the sub-pixel will be set. Given the correlation between reflectance levels and driving voltages, it will be apparent that the present embodiments may be implemented so as to instead analyze the current state of a sub-pixel, as well as that sub-pixel's current and target driving voltages to make decisions regarding the driving voltage to which the sub-pixel will be subjected. As such, analysis and comparison of the sub-pixel's current and target reflectance levels to various threshold values may be considered equivalent to a similar analysis and comparison of corresponding current and target driving voltages to equivalent driving voltage threshold values.

Electrowetting display driving system 300 as shown in FIG. 6 includes a display controller 308, e.g., a microcontroller or timing controller, receiving input data from the input data lines 306 relating to the image to be displayed. Display controller 308, being in this embodiment the control system controls a timing and/or a signal level of at least one signal level for a sub-pixel.

The output of display controller 308 is connected to the data input of a driver assembly 312. A signal distributor and data output latch 310 distributes incoming data over a plurality of outputs connected to the display device, via drivers in certain embodiments. The signal distributor and data output latch 310 causes data input indicating that a certain sub-pixel is to be set in a specific display state to be sent to the output connected to the sub-pixel. The distributor and data output latch 310 may be a shift register. The input data is clocked into the shift register and at receipt of a latch pulse the content of the shift register is copied to the distributor and data output latch 310. The outputs of the distributor and data output latch 310 are connected to the inputs of one or more driver stages 314 within the electrowetting display driving system 300. The outputs of each driver stage 314 are connected through electrode signal lines 302 and common signal line 304 to a corresponding sub-pixel. In response to the input data, a driver stage 314 will output a voltage of the signal level set by display controller 308 to set one of sub-pixels to a corresponding display state having a target reflectance level.

To assist in setting a particular sub-pixel to a target reflectance level, memory 316 may also store data that maps a particular driving voltage for a sub-pixel to a corresponding reflectance level and vice versa. As such, when display controller 308 identifies a target reflectance level for a particular sub-pixel, display controller 308 can use the data mapping driving voltage to reflectance level to identify a corresponding driving voltage. The sub-pixel can then be driven with that driving voltage.

As described below, however, the relationship between a sub-pixel's actual reflectance and the sub-pixel's driving voltage can depend upon the current state of the sub-pixel—whether the pixel is in an open state (transitioning from open-to-closed) or in a closed state (transitioning from closed-to-open). As such, memory 316 may store two sets of data that map particular reflectance level to driving voltages for sub-pixels in both open and closed states for various ranges of driving voltage. The data may be stored or represented in memory 316 in any suitable manner including curvilinear functions or a series of discrete data points that relate different reflectance levels to particular driving voltages for sub-pixels in open and closed states. Using the data, display controller 308 can then translate a particular target reflectance level for a sub-pixel to a corresponding driving voltage based upon the sub-pixel's current state.

As described below, display controller 308 may include or be connected to memory 316 configured to store a status of one or more sub-pixels in the display device. For example, memory 316 may store an indication of whether a particular sub-pixel is currently in an open or closed state. As display controller 308 causes the state of a particular sub-pixel to change (e.g., by opening a previously-closed state sub-pixel or closing a previously-open state sub-pixel), display controller 308 can update one or more entries in memory 316 to indicate the sub-pixel's current state. Because, for a given driving voltage, a sub-pixel's actual reflectance can depend upon the prior state of the sub-pixel (e.g., whether the sub-pixel was in an open or closed state before being driven at the given driving voltage), the sub-pixel state data stored in memory 316 can be utilized, as described herein, to more accurately control sub-pixel reflectance.

The sub-pixel state data may be stored within memory 316 in any suitable fashion. For example, within memory 316, a flag may be set for each sub-pixel within the display device indicating whether the sub-pixel is currently in an open state or a closed state. Alternatively, the sub-pixel state data may be stored in a bitmap, where the bitmap is a two-dimensional array of bits having a number of bits equal to the number of sub-pixels in the display. Each bit represents a particular sub-pixel and can then be toggled between different values (e.g., '0' and '1') to indicate the current state of a corresponding sub-pixel (e.g., where a value of '0' represents the pixel being in a closed state and a value of '1' represents the pixel being in an open state).

Figure 7:
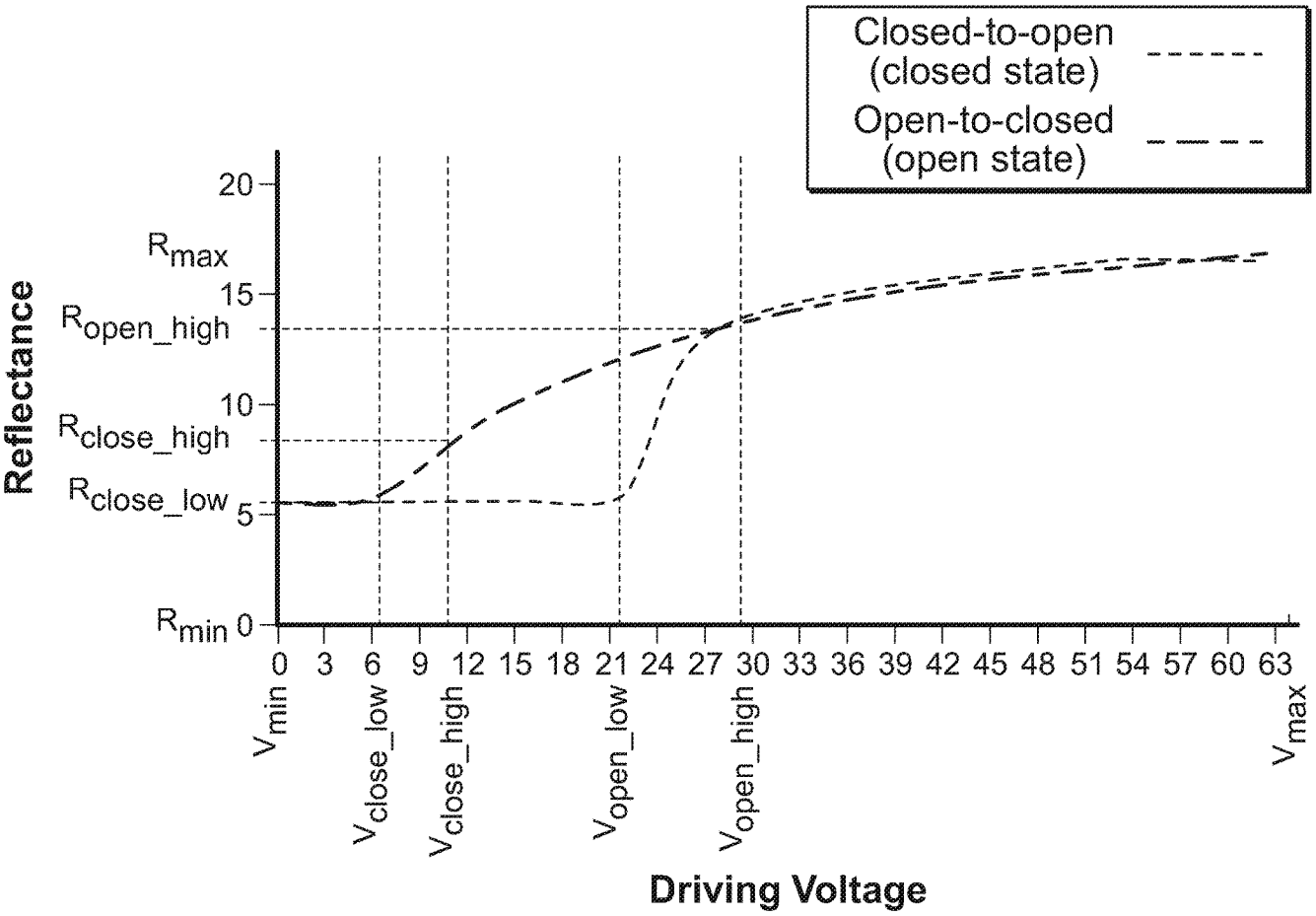
FIG. 7 is a graph depicting reflectance versus driving voltage for an example electrowetting pixel.

The dependency of a sub-pixel's reflectance on the prior state of the sub-pixel is referred to as hysteresis. FIG. 7 is a graph illustrating this hysteresis effect for an average sub-pixel within a display. In the graph, the horizontal axis represents a sub-pixel's driving voltage, while the vertical axis represents the sub-pixel's actual reflectance. The graph shows two curves. The first rising curve shows the average sub-pixel's reflectance versus voltage when the sub-pixel is transitioned from a closed state to an open state. The falling curve shows the average sub-pixel's reflectance versus voltage when the sub-pixel is transitioned from an open state to a closed state. As shown by the graph, the sub-pixel's reflectance shows relatively significant hysteresis spanning 25% of the driving voltage range and 60% of the reflectance range.

Starting with a low driving voltage $V_{min}$ and a group of closed-state sub-pixels, their average reflectance has a corresponding minimum level $R_{min}$. These sub-pixels, being driven at a low driving voltage have been forced closed and are, consequently in a closed state. As the driving voltage increases, the reflectance of those pixels will move along the closed-to-open curve. Accordingly, being in a closed-state does not necessarily mean that a sub-pixel is fully closed. In fact, a sub-pixel that is in a closed state could be partially open as its reflectance state moves along the closed-to-open curve, as shown in FIG. 7.

When the driving voltage increases beyond $V_{open_low}$ the average reflectance of the closed-state sub-pixels gradually starts to increase, as some individual sub-pixels begin opening to a reflectance level close to $R_{open\text{-}high}$, while others remain closed at the reflectance level $R_{close_low}$ (e.g., a minimum reflectance level). In the midpoint between $V_{open_low}$ and $V_{open_high}$ the reflectance increases faster, as more sub-pixels begin opening. When reaching the voltage level $V_{open_high}$, all sub-pixels have a high probability (e.g., greater than 95%) of being open. While each open sub-pixel has a reflectance of $R_{open_high}$, the average reflectance of these pixels is also $R_{open_high}$. When increasing the driving voltage towards $V_{max}$ the sub-pixel reflectance increases to $R_{max}$.

When the driving voltage for a sub-pixel reaches or exceeds $V_{open_high}$, the closed-state sub-pixels have been forced open and enters an open state. Once the sub-pixels have entered the open state, variations in the driving voltage of the open-state sub-pixels will cause the reflectance of those sub-pixels to move along the open-to-closed curve of FIG. 7. As such, a sub-pixel that is in an open state is not necessary 100% open. As illustrated by FIG. 7, as the driving voltage of an open-state sub-pixel is varied, the reflectance of the open-state sub-pixel travels along the open-to-closed curve and, as such, the reflectance and the degree to which the sub-pixel is open, will vary.

In the present disclosure, $R_{open_high}$ refers to a lowest reflectance level above which a closed-state sub-pixel transitions to an open-state sub-pixel from a closed-state sub-pixel. $R_{open_high}$, therefore, is a reflectance level corresponding to a driving voltage level above which a closed sub-pixel has a high probability (e.g., greater than 95%) of opening when driven to this driving voltage for at least one addressing cycle.

In the present disclosure, an addressing cycle may refer to a single operating cycle of display controller 308 analyzing data 306 to determine a target reflectance level for a sub-pixel, converting that target reflectance level to a corresponding driving voltage (if necessary), and subjecting the sub-pixel to that driving voltage until controller 308 again reads data 306 to determine a new reflectance level. As such, the addressing cycle may occur every time new data is retrieved from data 306 by display controller 308. Consequently, the addressing cycle may be equal to the minimum amount of time between a sub-pixel being set to a first reflectance level and the sub-pixel being set to a second reflectance level. The duration of an addressing cycle may change based upon the operation of display driving system 300 and so may not be a fixed period of time, but in various embodiments could be approximately 1/60 of a second.

In the present disclosure, $R_{close_high}$ refers to a lowest reflectance above which an open state sub-pixel will remain open before closing to a minimum reflectance level. Or, alternatively, a highest reflectance below which an open sub-pixel will close. $R_{close_high}$, therefore, is a lowest reflectance corresponding to a lowest driving voltage level above which an open sub-pixel has a high probability (e.g., greater than 95%) of remaining open.

When a group of sub-pixels is transitioning from closed to opened, for driving voltages between $V_{open_low}$ and $V_{open_high}$, the actual reflectance of a particular sub-pixel cannot be predicted with confidence, as the moment of actual opening, corresponding to the actual driving voltage, has a statistical variation.

Conversely, when starting with a high driving voltage $V_{max}$, the average sub-pixel reflectance has a maximum level $R_{max}$ as all the sub-pixels are fully open. For driving voltages above $V_{close_high}$ the reflectance of the sub-pixels is relatively linear. But when the driving voltage decreases below $V_{close_high}$ along the open-to-closed curve, the average reflectance gradually starts to decrease faster, as some individual sub-pixels are closing to the reflection level $R_{close_low}$, while others remain opened at the reflectance level close to $R_{close_high}$. In the midpoint between $V_{close_low}$ and $V_{close_high}$ the reflectivity decreases more rapidly, as more sub-pixels begin closing. When reaching the voltage level $V_{close_low}$ all sub-pixels are closed. While each sub-pixel has a reflectance of $R_{close_low}$, the average reflectance of these pixels is also $R_{close_low}$. For driving opened sub-pixels with voltages above $V_{close_high}$, the sub-pixel's reflectance is known and predictable. Similarly, for driving voltages below $V_{close_low}$, the sub-pixel is known to be closed and with minimum reflectance $R_{min}=R_{close_low}$. When a group of sub-pixels is transitioning from opened to closed, for driving voltages between $V_{close_low}$ and $V_{close_high}$, the state of a particular sub-pixel cannot be known with confidence, as the moment of opening, corresponding to the actual driving voltage, has a statistical variation.

Accordingly, for driving voltage values between $V_{close_low}$ and $V_{close_high}$, in the case of a sub-pixel transitioning from open-to-closed (i.e., a sub-pixel in an open state), and for driving voltage values between $V_{open_low}$ and $V_{open_high}$, in the case of a sub-pixel transitioning from closed-to-open (i.e., a sub-pixel in a closed state), the particular sub-pixel reflectance cannot be confidently predicted.

Due to this hysteresis effect—the difference between the rising and falling driving voltage-reflectance curves—and the uncertain sub-pixel opening and closing characteristics, given a particular initial state of a sub-pixel (e.g., closed state or open state) there are certain reflectance levels that cannot be reliably achieved should the sub-pixel simply be driven at a driving voltage corresponding to the target reflectance level.

To provide for the predictable achievement of a target reflectance level for a particular sub-pixel, therefore, a quantization process is provided in which reflectance levels that are difficult to achieve within a particular sub-pixel are avoided (i.e., not used). This approach may also mitigate the effects of the relatively large gain in parts of the display device's grayscale range, as well as the reduced number of brightness or reflectance levels due to the limited resolution of the display driver interface. Because, in some embodiments, this quantization process may introduce visual artifacts, like missing grey levels, error diffusion techniques are also presented to mitigate the lack of grey scale resolution in darker colors and possible color banding. The error diffusion technique may involve the utilization of Pentile-specific error diffusion coefficients, adaptive metamer mapping, and adaptive spatial subsampling, as described herein.

The quantization scheme is in large part determined by the lowest reflectance level above which the reflectance for a particular sub-pixel can be set accurately, referred to herein as the threshold reflectance level Rth. At lower reflectance levels, the reflectance of a particular sub-pixel cannot be set precisely. With reference to FIG. 7, for example, the threshold reflectance level Rth may be equal to $R_{close_low}$. In other embodiments, however, the threshold reflectance level Rth may be any suitable reflectance level, such as $R_{close_high}$ or $R_{open_high}$.

With the threshold reflectance level Rth defined, a controller, such as controller 308, is configured to quantize the target reflectance levels for sub-pixels of the display device according to the following method. Because the quantization scheme compensates for sub-pixel state hysteresis effects described above, the quantization of reflectance levels for a particular sub-pixel depends on the sub-pixel's previous state—e.g., whether the sub-pixel is open or closed.

Figure 8:
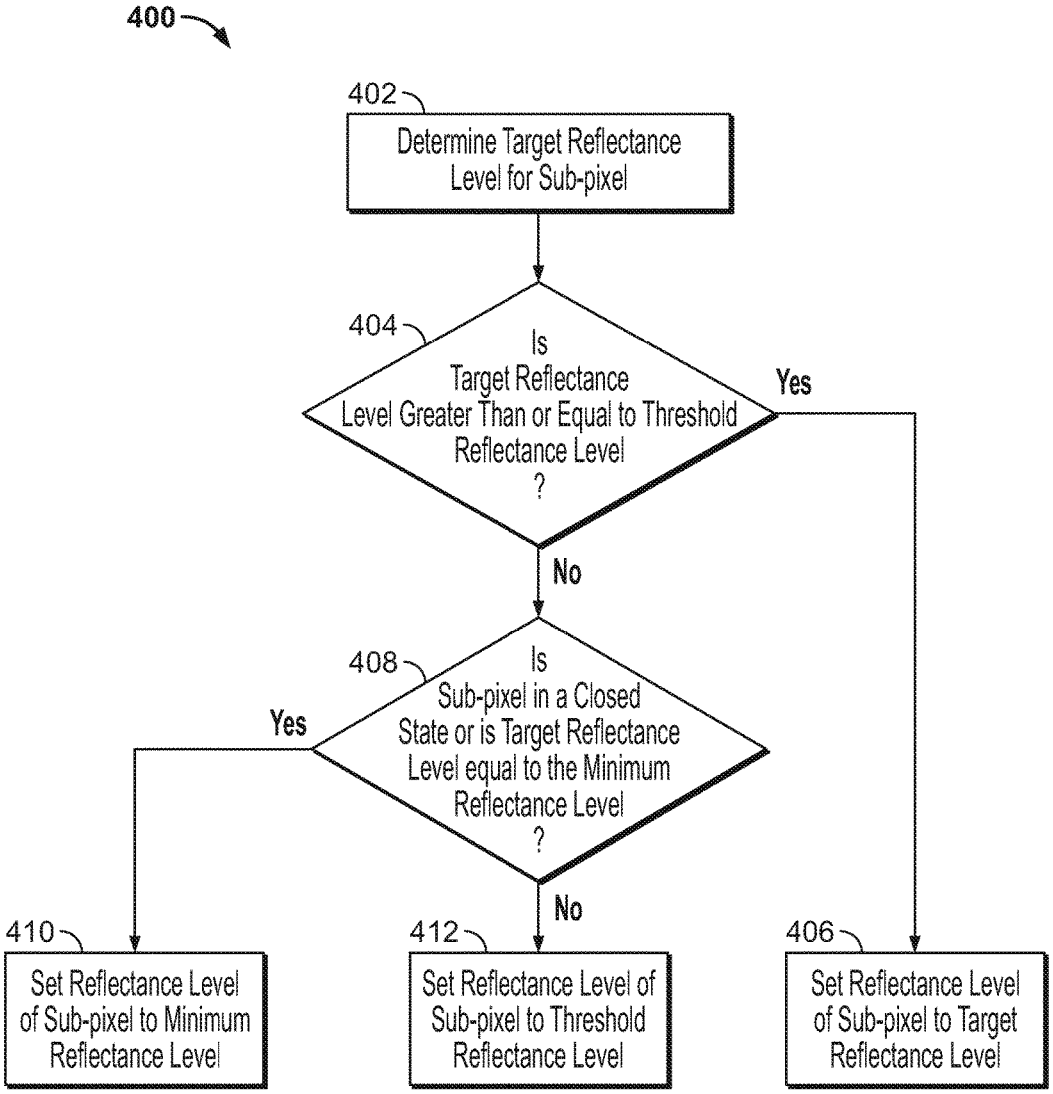
FIG. 8 is a flowchart illustrating a method for quantizing a target reflectance level for a sub-pixel in a display device.

FIG. 8 is a flowchart illustrating a method for quantizing a target reflectance level for a sub-pixel in a display device. The method illustrated in FIG. 8 may be applied to quantize target reflectance levels for each sub-pixel in the display device. The method could be executed iteratively against each sub-pixel or against a number of sub-pixels at the same time. The method may be executed against a series of sub-pixels in a particular row of sub-pixels before being executed against sub-pixels in the next adjoining row. The method may be executed by a display controller (e.g., a timing controller or other processor or controller) in the display device.

In step 402, a target reflectance level is determined for the current sub-pixel. As described above, the target reflectance level can be determined by any suitable method and may involve the analysis of video or other graphical data transmitted to the display controller. In step 404, a determination is made as to whether the target reflectance level is greater than or equal to the threshold reflectance level. If so, the target reflectance level is sufficiently high (i.e., exceeds the threshold level) then the sub-pixel can predictably be set to the target reflectance level. As such, in step 406, the reflectance for the sub-pixel is set to the target reflectance level.

If, however, in step 404 it is determined that the target reflectance level is less than or equal to the threshold level, then it may not be possible to reliably set the sub-pixel to the target reflectance level. As such, the reflectance of the sub-pixel is quantized to either a minimum reflectance level or the threshold reflectance level, both of which represent reflectance levels that can be confidently established within the sub-pixel.

In step 408, therefore, a determination is made as to whether the sub-pixel is in a closed state or whether the target reflectance level is equal to a minimum reflectance level. The determination of the open or closed state for the sub-pixel may involve the display controller accessing a memory in which state data is stored for the sub-pixel. In either case, the sub-pixel can be reliably set to the minimum reflectance level (e.g., driven with a minimum driving voltage). As such, in step 410, if the sub-pixel is closed or the target reflectance level is equal to the minimum reflectance level, the reflectance of the sub-pixel is set to the minimum reflectance level.

If, however, in step 408 it is determined that the sub-pixel is in an open state and that the target reflectance level is not the minimum reflectance level, the sub-pixel can reliably be set to a reflectance level of the threshold reflectance level. As such, in step 412, the reflectance level of the sub-pixel is set to the threshold reflectance level.

Accordingly, after completion of the quantization method illustrated in FIG. 8, the target reflectance level for a particular sub-pixel is quantized to a value of either the minimum reflectance level or values equal to or greater than the threshold reflectance level. Reflectance levels between the minimum reflectance level and the threshold reflectance level are thereby avoided.

Although this quantization approach avoids the setting of sub-pixels to reflectance levels that cannot be accurately realized, this approach may result in some visual artifacts that could be noticed by an observer. This may be because the quantization scheme generally identifies a band of reflectance levels (e.g., reflectance levels greater than 0 but less than Rth) as being invalid. Those reflectance levels, therefore, are not used, potentially resulting in visual artifacts in the display device. To improve the perceived resolution of grayscales within the images rendered by the display device, an error diffusion scheme may be utilized to distribute the reflectance error resulting from the reflectance level quantization of a single sub-pixel to neighboring sub-pixels within the display to achieve a target average reflectance level over a number of sub-pixels. In some embodiments, the quantization reflectance error is only distributed to other sub-pixels of the same color.

Figure 9A:
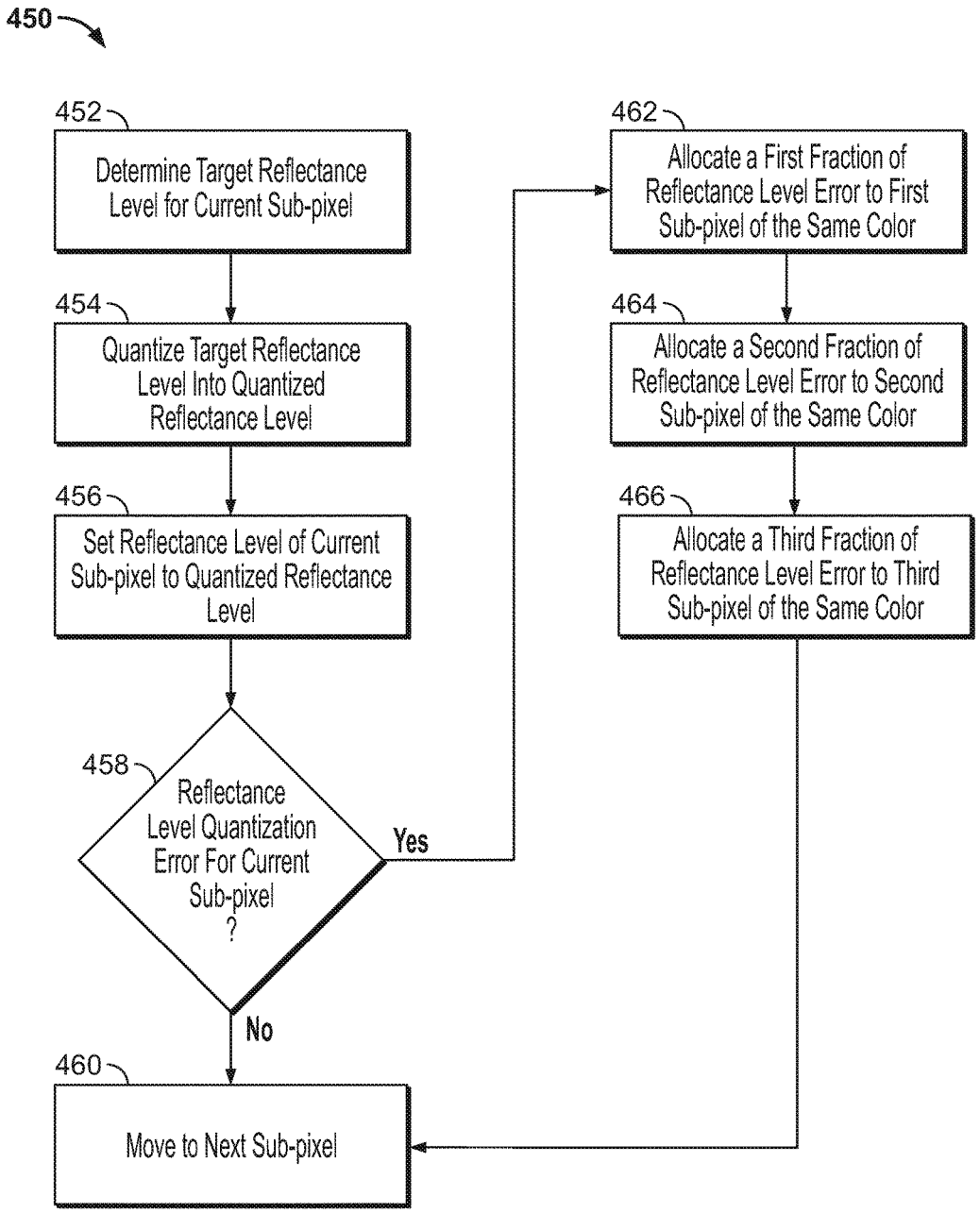
FIG. 9A is a flow chart illustrating an error diffusion method for a display device having red, green, blue, and white sub-pixels.
Figure 9B:
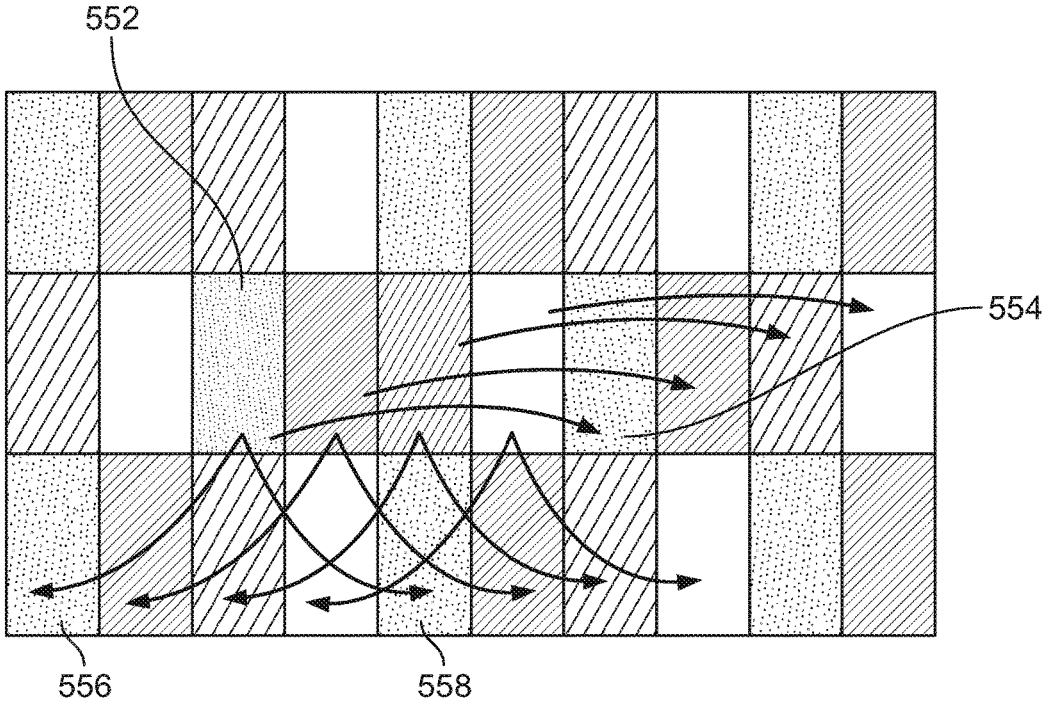
FIG. 9B depicts steps of the error diffusion method of FIG. 9A.

FIG. 9A is a flow chart illustrating an error diffusion method for a display device having red, green, blue, and white sub-pixels. FIG. 9B depicts steps of the error diffusion method of FIG. 9A. FIG. 9B depicts a number of sub-pixels arranged in a pixel array of a display panel (e.g., display panel 110).

In FIG. 9A, method 450 may be implemented for each sub-pixel within a display, with the display controller implementing the method for a first sub-pixel and then moving to a next sub-pixel and re-executing the method. When executing the method, the display controller can iterate through the display's sub-pixels in any suitable manner. For example, the display controller may iterate through sub-pixels from left to right, and top to bottom. Alternatively, the display controller may iterate through each row of sub-pixels in opposite directions or skip some number of rows.

In step 452, a target reflectance level is determined for the sub-pixel being analyzed (in this example, sub-pixel 552 of FIG. 9B). This may involve analyzing video or graphical data describing a source image that should be depicted by the display device. The target reflectance level may also be dependent upon a quantization error that may arise from the quantization of reflectance levels of previously-analyzed sub-pixels. If, for example, the quantization error indicates that a prior sub-pixel being driven is with a reflectance level that is higher than desired (e.g., the quantization error is a positive value), the display controller may reduce the target reflectance level for the present sub-pixel by a corresponding amount to offset that error by subtracting the quantization error from the target reflectance level.

After the target reflectance level is determined, in step 454 the target reflectance level is quantized. The target reflectance level may be quantized, for example, according to the method illustrated in FIG. 8 and described above. After the target reflectance level is quantized, in step 456 the sub-pixel is set to the quantized reflectance level. As discussed above, step 456 may involve setting the reflectance level of the sub-pixel to a minimum reflectance level or a reflectance level equal to or greater than the threshold reflectance level.

Once the target reflectance level is quantized, in step 458 a determination is made as to whether the quantization of the target reflectance level results in a reflectance level quantization error. The error can be determined by calculating the difference between the target reflectance level for the sub-pixel and the reflectance level to which the sub-pixel was actually set (i.e., the quantized reflectance value). If there is no error (i.e., the target reflectance level for the sub-pixel and the quantized reflectance level are the same), the method moves to step 460 and the display controller can then perform error diffusion for another sub-pixel in the display device.

If, however, in step 458 it is determined that there exists a reflectance level quantization error (i.e., the target reflectance level for the sub-pixel is not equal to the quantized reflectance level), the reflectance level quantization error is distributed amongst other sub-pixels in the display panel 110. Accordingly, after the quantization error is determined by calculating the difference between the target reflectance level for the sub-pixel and the quantized reflectance levels, that quantization error is used to modify the reflectance levels for sub-pixels in the vicinity of the sub-pixel 552 being analyzed.

In step 462, a first fraction of the reflectance level quantization error is allocated to a first sub-pixel in the vicinity of the sub-pixel being analyzed. In this example, the first sub-pixel is the sub-pixel of the same color as the sub-pixel being analyzed that is located in the pixel to the right of and adjacent to the pixel containing the sub-pixel being analyzed. Referring to FIG. 9B, that is sub-pixel 554. If it is determined that the sub-pixel being analyzed is at a side edge of the display panel, i.e., there is no sub-pixel of the same color as the sub-pixel being analyzed to the right of and adjacent the pixel containing the sub-pixel being analyzed, there is no allocation of the first fraction of the reflectance level quantization error. In one specific embodiment, ½ of the reflectance level quantization error is allocated to sub-pixel 554. In order to allocate the first fraction of the reflectance level quantization error to sub-pixel 554, a reflectance level amount equal to the reflectance level quantization error multiplied by ½ is added to the target reflectance level of sub-pixel 554. In various other embodiments, fractions other than ½ may be used depending upon the design of the display device and arrangement of sub-pixels in the display panel.

In step 464, a second fraction of the reflectance level quantization error is allocated to a second sub-pixel in the vicinity of the sub-pixel being analyzed. In this example, the second sub-pixel is the sub-pixel of the same color as the sub-pixel being analyzed that is located in the pixel to the bottom-left of and adjacent to (i.e., with no intervening pixel) the pixel containing the sub-pixel being analyzed. Referring to FIG. 9B, that is sub-pixel 556. If it is determined that the sub-pixel being analyzed is at a bottom edge of the display panel, i.e., a line or row counter determines that the sub-pixel being analyzed is in a last line or row of the display panel and there is no sub-pixel of the same color as the sub-pixel being analyzed to the bottom-left of and adjacent the pixel containing the sub-pixel being analyzed, there is no allocation of the second fraction of the reflectance level quantization error. In one specific embodiment, ¼ of the reflectance level quantization error is allocated to sub-pixel 556. In order to allocate the second fraction of the reflectance level quantization error to sub-pixel 556, a reflectance level amount equal to the reflectance level quantization error multiplied by ¼ is added to the target reflectance level of sub-pixel 556. In various other embodiments, fractions other than ¼ may be used depending upon the design of the display device and arrangement of sub-pixels in the display panel.

In step 466, a third fraction of the reflectance level quantization error is allocated to a third sub-pixel in the vicinity of the sub-pixel being analyzed. In this example, the third sub-pixel is the sub-pixel of the same color as the sub-pixel being analyzed that is located in the pixel to the bottom-right of and adjacent to (i.e., with no intervening pixel) the pixel containing the sub-pixel being analyzed. Referring to FIG. 9B, that is sub-pixel 558. If it is determined in step 464 that the sub-pixel being analyzed is at a bottom edge of the display panel, i.e., a line or row counter determines that the sub-pixel being analyzed is in a last line or row of the display panel, there is no allocation of the third fraction of the reflectance level quantization error. In one specific embodiment, ¼ of the reflectance level quantization error is allocated to sub-pixel 558. In order to allocate the third fraction of the reflectance level quantization error to sub-pixel 558, a reflectance level amount equal to the reflectance level quantization error multiplied by ¼ is added to the target reflectance level of sub-pixel 558. In various other embodiments, fractions other than ¼ may be used depending upon the design of the display device and arrangement of sub-pixels in the display panel.

With the reflectance level of sub-pixel 552 set and the reflectance level quantization error distributed to other sub-pixels, the display controller can then move to step 460 and begin processing the next sub-pixel in the display by re-executing method 450. The new target reflectance levels calculated for sub-pixels 554, 556, and 558 will be used when method 450 is executed against those sub-pixels.

The error diffusion approach illustrated in FIGS. 9A and 9B may be utilized in an electrowetting display device in which the device's pixels and sub-pixels are arranged in accordance with a PENTILE RGBW L6W pixel structure. In contrast to a more conventional "stripe" sub-pixel arrangement, in which case display errors can be diffused to the nearest sub-pixel, which will always be directly below the sub-pixel being analyzed, in the sub-pixel arrangement illustrated in FIG. 9B, error is diffused to a number of nearby sub-pixels where the nearby sub-pixels may be on the same row of sub-pixels as the sub-pixel being analyzed or a different row. By allocating ½ of the reflectance level error to a sub-pixel in the same row of pixels as the sub-pixel being processed, a majority of the reflectance level error is allocated to the closest sub-pixel that can be addressed closest in time. The other nearby sub-pixels (e.g., sub-pixels 556 and 558 in FIG. 9B) are in a different row and, therefore, are not addressed at the same time as sub-pixel 554. As such, a reduced amount of the reflectance level error (¼ each) is allocated to those sub-pixels.

In a display device that has red, green, blue, and white sub-pixels, the visibility of white sub-pixels set to quantized reflectance levels may be more distinct or apparent to an observer as compared to similarly quantized red, green, or blue sub-pixels on an RGBW display panel. White sub-pixels may appear sharper and more apparent to an observer because the luminance of white sub-pixels is generated in an area that may be 3 times smaller than grey colors represented by sub-pixels of other colors. Accordingly, in some embodiments, before executing the error diffusion approach illustrated in FIGS. 9A and 9B, some of the white sub-pixels within the display device may be forced into a closed state with the reflectance levels of neighboring red, green, and blue sub-pixels being increased in compensation. Such an approach can involve conditionally mapping reflectance levels of white sub-pixels to neighboring RGB sub-pixels while preserving a highest possible spatial resolution. The approach may also involve conditionally sub-sampling RGB sub-pixels and distributing the related reflectance levels to their neighboring RGB sub-pixels, preserving the highest possible spatial resolution.

In one implementation, a white sub-pixel in an RGBW pixel group is driven to a minimum reflectance level (e.g., black) when the target reflectance level for the white sub-pixel is in a difficult to achieve range (e.g., greater than 0 but less than Rth) as long as the corresponding increase in the reflectance levels of neighboring red, green, and blue sub-pixels would not exceed their maximum reflectance levels. By distributing reflectance from the white sub-pixel to surrounding sub-pixels of other colors, the brightness of the white sub-pixel is now distributed over an area that is typically three times larger than the size of the white sub-pixel alone.

Furthermore, as the reflectance levels of the neighboring red, green, and blue sub-pixels increase due to the addition of reflectance that was otherwise reduced for the white sub-pixel, there is a reduced chance that the reflectance levels are in the quantization range (e.g., less than Rth). This can further reduce the need for quantization and error diffusion in the display device.

A perceived matching of colors that, based on differences in spectral power distribution, do not actually match is commonly referred to in the colorimetry art as metamerism and colors that match this way are called metamers. The approach as described herein of transferring reflectance levels from a white sub-pixel into surrounding sub-pixels of other colors such that the overall color perceived by the user of the display device is matched to the particular color indicated by the tuple of a red (R) value, a green (G) value, and a blue (B) value specified for a corresponding source image pixel 51 within image data 50 is referred to herein as metamer mapping. This metamer mapping approach may reduce the spatial resolution of unsaturated colors in one or two directions, depending on the 1D or 2D filtering implementation of the mapping process.

Figure 10:
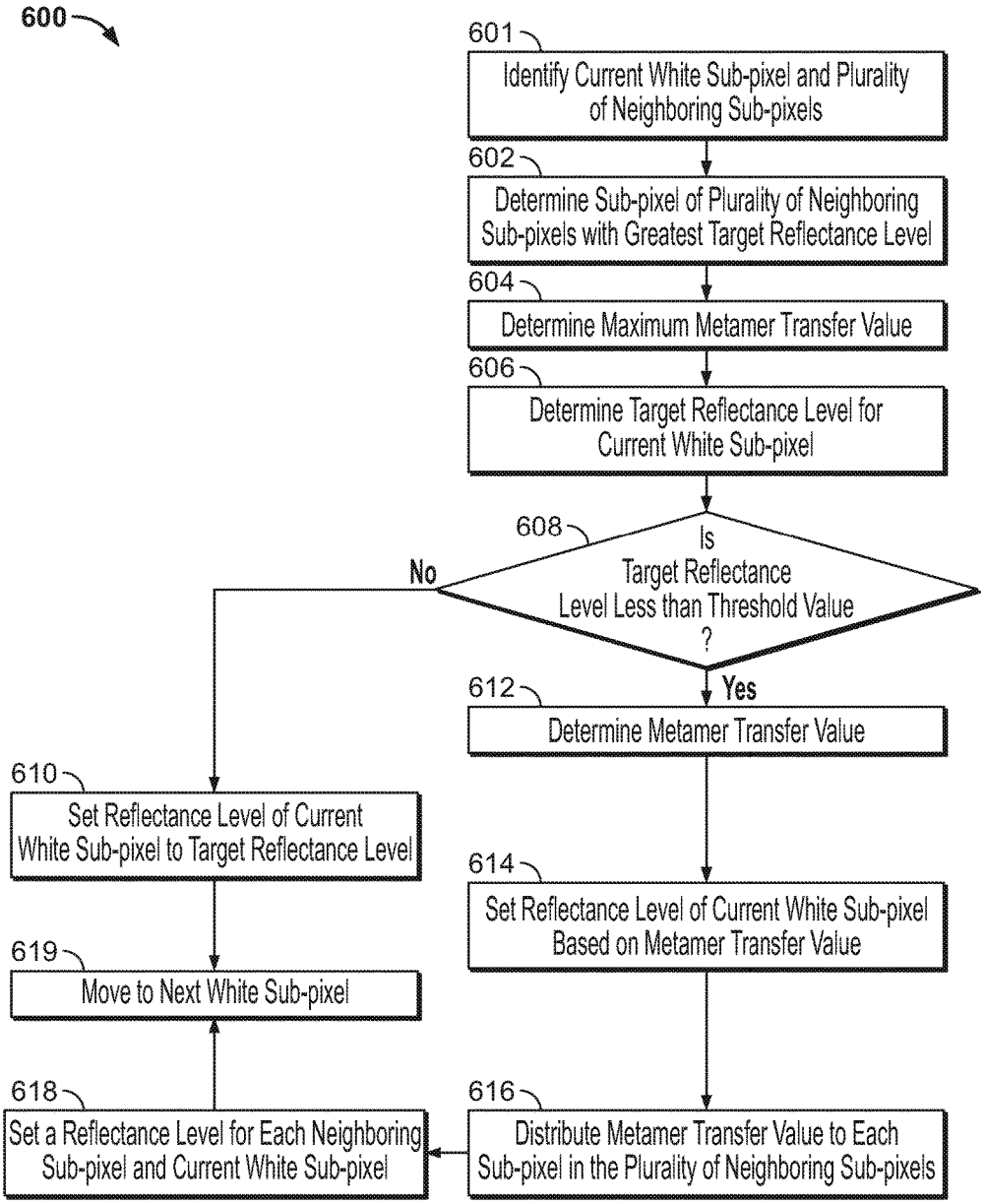
FIG. 10 is a flowchart illustrating a white sub-pixel metamer mapping process.
Figure 11:
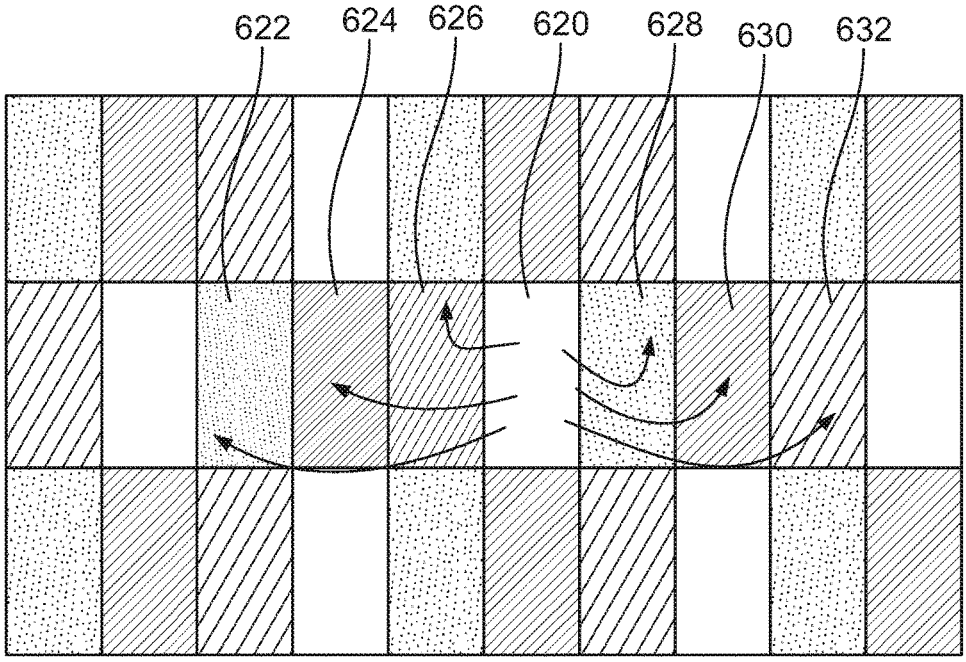
FIG. 11 depicts steps of the mapping process of FIG. 10 and shows a number of sub-pixels arranged in a pixel array of a display panel.

To illustrate, FIG. 10 is a flowchart illustrating a white sub-pixel metamer mapping process. FIG. 11 depicts steps of the metamer mapping process of FIG. 10 and shows a number of sub-pixels arranged in a pixel array of a display panel (e.g., display panel 110).

Method 600 illustrates an example metamer mapping method for allocating reflectance levels from white sub-pixels in a display to other sub-pixels of different colors. In order to prevent clipping of the red, green and blue sub-pixels during the metamer mapping method, or a subsequent error diffusion method, as described with reference to FIGS. 8 and 9A, in step 601 a current white sub-pixel for processing and a number or a plurality of neighboring sub-pixels to the current white sub-pixel being processed are identified. With reference to FIG. 11, for example, the current white sub-pixel is identified as white sub-pixel 620 and the neighboring sub-pixels may include red sub-pixel 622, green sub-pixel 624, blue sub-pixel 626, red sub-pixel 628, green sub-pixel 630, and blue sub-pixel 632. The set of neighboring sub-pixels may be identified in any manner. For example, the set of neighboring sub-pixels may include any number of sub-pixels. The neighboring sub-pixels may all occupy the same row within the display device (which may or may not include the white sub-pixel being processed) or may occupy two or more different rows of sub-pixels within the display device. The set of neighboring sub-pixels may include sub-pixels that are adjacent to (i.e., with no intervening sub-pixel) the white sub-pixel being processed. The set of neighboring sub-pixels may also include sub-pixels of any colors (including white sub-pixels). In FIG. 11, blue sub-pixel 626 and red sub-pixel 628 are each adjacent to white sub-pixel 620. Two adjacent sub-pixels are sufficiently close to one another that there is no intervening sub-pixel located between the two adjacent sub-pixels. The set of neighboring sub-pixels may also include neighboring sub-pixels that are not adjacent to the white sub-pixel being processed. The set of neighboring sub-pixels may include sub-pixels of different colors and may include white sub-pixels, in some cases.

In step 602, a determination is made as to which sub-pixel of the plurality of neighboring sub-pixels, e.g., red sub-pixel 628, green sub-pixel 630, and blue sub-pixel 632, has the greatest target reflectance level and a maximum metamer transfer value, e.g., a maximum value for a reflectance of the subject white sub-pixel that can be transferred or distributed to the neighboring sub-pixels of different colors without clipping, for the subject white sub-pixel is determined 604 based at least in part on the determination of the sub-pixel having the greatest target reflectance level. In the example embodiment, if a target reflectance level of the red sub-pixel is greater than or equal to a target reflectance level of the green sub-pixel and the target reflectance level of the red sub-pixel is greater than or equal to a target reflectance level of the blue sub-pixel, the maximum metamer transfer value is equal to (1−the target reflectance level of the red sub-pixel). If, alternatively, the target reflectance level of the green sub-pixel is greater than or equal to the target reflectance level of the red sub-pixel and the target reflectance level of the green sub-pixel is greater than or equal to a target reflectance level of the blue sub-pixel, the maximum metamer transfer value is equal to (1−the target reflectance level of the green sub-pixel). If, alternatively, the target reflectance level of the blue sub-pixel is greater than or equal to a target reflectance level of the red sub-pixel and the target reflectance level of the blue sub-pixel is greater than or equal to a target reflectance level of the green sub-pixel, the maximum metamer transfer value is equal to (1−the target reflectance level of the blue sub-pixel).

With the maximum metamer transfer value determined, in step 606, a target reflectance level is determined for the current white sub-pixel in the display. As described above, the target reflectance level for the current white sub-pixel can be determined by any suitable method and may involve the analysis of video or other graphical data transmitted to the display controller. In step 608, a determination is made as to whether the target reflectance level of the current white sub-pixel is less than the threshold reflectance level. If not, the target reflectance level of the current white sub-pixel is sufficiently high (i.e., the target reflectance level is equal to or exceeds the threshold level) so that the current white sub-pixel can predictably be set to the target reflectance level. As such, in step 610, the reflectance for the current white sub-pixel is set to the target reflectance level. The method may then move to step 619 and method 600 may be repeated on the next white sub-pixel.

If, however, in step 608 it was determined that the target reflectance level for the current white sub-pixel is less than the threshold reflectance level, a metamer transfer value, i.e., a quantization reflectance level error for the current white sub-pixel, is determined 612. In step 612, if the target reflectance level of the current white sub-pixel is less than or equal to a threshold reflectance level divided 2 and the target reflectance level of the current white sub-pixel is greater than or equal to the maximum metamer transfer value determined in step 606, the metamer transfer value is equal to the maximum metamer transfer value to be distributed to each of the neighboring red, green and blue sub-pixels, e.g., the metamer transfer value is added to the target reflectance value of each of the neighboring red, green and blue sub-pixels. If, alternatively, the target reflectance level of the current white sub-pixel is less than or equal to the threshold reflectance level divided 2 and the target reflectance level of the current white sub-pixel is less than the maximum metamer transfer value determined in step 606, the reflectance level of the current white sub-pixel is set to the minimum reflectance level, i.e., the current white sub-pixel is closed, and the metamer transfer value is equal to the target reflectance level of the current white sub-pixel to be distributed to each of the neighboring red, green and blue sub-pixels. Alternatively, if the target reflectance level of the current white sub-pixel is less than the threshold reflectance level and the threshold reflectance level minus the target reflectance level of the current white sub-pixel is greater than or equal to the maximum metamer transfer value determined in step 606, the metamer transfer value is equal to the maximum metamer transfer value to be distributed to each of the neighboring red, green and blue sub-pixels. If, alternatively, the target reflectance level of the current white sub-pixel is less than the threshold reflectance level and the threshold reflectance level minus the target reflectance level of the current white sub-pixel is less than the maximum metamer transfer value determined in step 606, the metamer transfer value is equal to the threshold reflectance level minus the target reflectance level of the current white sub-pixel, to be distributed to each of the neighboring red, green and blue sub-pixels. If none of the above conditions are met, the metamer transfer value, i.e., the quantization reflectance level error, is equal to 0, i.e., there is no metamer transfer value.

In step 614, the reflectance level of the current white sub-pixel is set based on the determination of the metamer transfer value in step 612. This may involve, for example, setting the driving voltage for the white sub-pixel to a minimum driving voltage. This reduces the actual reflectance level of the white sub-pixel as compared to the target reflectance level, resulting in the metamer transfer value. If there is no metamer transfer value, in step 619 the method moves on to the next white sub-pixel and may be repeated. If, however, in step 612 it is determined that a metamer transfer value exists, that metamer transfer value is distributed 616 to each sub-pixel of the neighboring sub-pixels in the display device identified in step 601. In step 616 the metamer transfer value determined in step 612 is distributed to each sub-pixel of the number of sub-pixels, e.g., the plurality of neighboring sub-pixels identified in step 601. Referring to FIGS. 10 and 11, in an example embodiment, the metamer transfer value determined in step 612 is distributed 616 to each of red sub-pixel 628, green sub-pixel 630, and blue sub-pixel 632 and a reflectance level for each of red sub-pixel 628, green sub-pixel 630, blue sub-pixel 632 and white sub-pixel level 620 is set 618. In this embodiment, the reflectance level for red sub-pixel 628 will be set to the target reflectance level of red sub-pixel 628 plus the metamer transfer value, the reflectance level for green sub-pixel 630 will be set to the target reflectance level of green sub-pixel 630 plus the metamer transfer value, the reflectance level for blue sub-pixel 632 will be set to the target reflectance level of blue sub-pixel 632 plus the metamer transfer value, and the reflectance level for white sub-pixel 620 will be set to the target reflectance level of white sub-pixel 620 minus the metamer transfer value. In example embodiments, the target reflectance level of red sub-pixel 628, green sub-pixel 630, blue sub-pixel 632 and white sub-pixel level 620 is determined based at least in part on image data for a corresponding source image pixel. In other embodiments, the reflectance of white sub-pixel 620 may be distributed to neighboring red sub-pixel 622, green sub-pixel 624, blue sub-pixel 626, red sub-pixel 628, green sub-pixel 630, and blue sub-pixel 632. Accordingly, the reflectance level that would otherwise be allocated to white sub-pixel 620 is redistributed to the neighboring sub-pixels. A white sub-pixel 620 can reduce its brightness and can be fully closed, in which case the increases in reflectance of the neighboring sub-pixels makes up for the reduced reflectance of closed white sub-pixel 620. In certain embodiments, a subsequent error diffusion method will address situations in which a residual reflectance level remains in white sub-pixel 620 after distribution of the metamer transfer value to neighboring sub-pixels. After the reflectance level of the white sub-pixel being processed has been redistributed amongst the neighboring sub-pixels the method moves to step 619 and processing of a next white sub-pixel in the display device begins.

In some embodiments, the reflectance level of the white sub-pixel will only be partially redistributed to the neighboring sub-pixels and hence the redistribution will not result in the reflectance levels of the neighboring sub-pixels clipping. Clipping would result if the redistribution of reflectance level of the white sub-pixels to a neighboring sub-pixel causes the resulting target reflectance level for that sub-pixel to exceed a maximum reflectance level. For example, if a white sub-pixel has a luminance below a specific level, the white sub-pixel is driven to black and the brightness is redistributed to neighboring sub-pixels. However, if the neighboring sub-pixels, e.g., the sub-pixels to the left and right of the white sub-pixel, are driven at a maximum reflectance level, the reflectance level of the white sub-pixel cannot be redistributed to the neighboring sub-pixels and the metamer mapping is not allowed. If the neighboring sub-pixels, e.g., the sub-pixels to the left and right of the white sub-pixel, are driven at a high reflectance level, reduction of the brightness of the white sub-pixel is limited to the maximum transferable reflection without clipping of the sub-pixels to the left and right of the white sub-pixel.

In some embodiments, method 600 illustrated in FIG. 10 may be executed to adjust the reflectance level of each white sub-pixel in a display device by redistributing the reflectance level to neighboring sub-pixels. After method 600 has been executed for a number of white sub-pixels in the display device, method 400 of FIG. 8 may be executed to quantize and redistribute reflectance level error for each sub-pixel in the display device. Accordingly, method 600 and method 400 may be executed together to adjust and control reflectance levels for sub-pixels with the display device.

In one implementation, method 600 is first executed for each sub-pixel in a display device. As such, the reflectance levels for white sub-pixels are set to minimum reflectance levels. The resulting reflectance level error is then compensated for by increasing initial target reflectance levels for neighboring sub-pixels to target reflectance levels that compensate for the reduced reflectance levels of the white sub-pixels. Those new target reflectance levels (determined using method 600) can then be quantized and any resulting error redistributed according to method 400.

The present quantization and error diffusion processes may be utilized within various types of display devices including electrowetting display devices. In some cases, the display device may include a pixel configuration that includes a Pentile L6W pixel layout.

In some display device implementations, the brightness of green sub-pixels is (or is perceived to be) about 0.7 times the brightness of white sub-pixels on an RGBW display panel and more than about three times the brightness of red and blue sub-pixels. Accordingly, in some embodiments, the reflectance level of relatively low-level reflectance level green sub-pixels (e.g., having a reflectance level below the threshold reflectance level) may be transferred to adjacent green sub-pixels, such that the highest spatial frequencies are preserved for those sub-pixels during this dithering process and the locally created error is diffused towards neighboring sub-pixel, using an error diffusion technique.

As the reflectance levels of adjacent RGBW pixels become brighter due to the addition of the some reflectance level (to compensate for the reduction in reflectance level of the green sub-pixels), there may also be a reduced likelihood that these components are in the quantized reflectance level range (e.g., reflectance levels between a minimum reflectance level and Rth), and so a smaller image area may be quantized and dithered. Application of this subsampling technique may reduce the spatial resolution of low intensity colors in both horizontal and vertical directions, according to the corresponding error diffusion settings.

In a Pentile embodiment, this involves analyzing the target reflectance levels for each green sub-pixel in a first row of pixels of the display device. If the target reflectance levels are below a threshold level (e.g., Rth), the reflectance levels for those green sub-pixels are set to a minimum reflectance level. The resulting reflectance level error is compensated for by increasing the target reflectance levels in the green sub-pixels in the next row of pixels of the display device. This approach can then be repeated for all green sub-pixels in the display device. For example, the green sub-pixels in the display device's even numbered pixel rows could be evaluated and driven to a minimum reflectance level when suitable, with the resulting reflectance error being diffused into the green sub-pixels in the display device's odd rows of pixels.

Figure 12A:
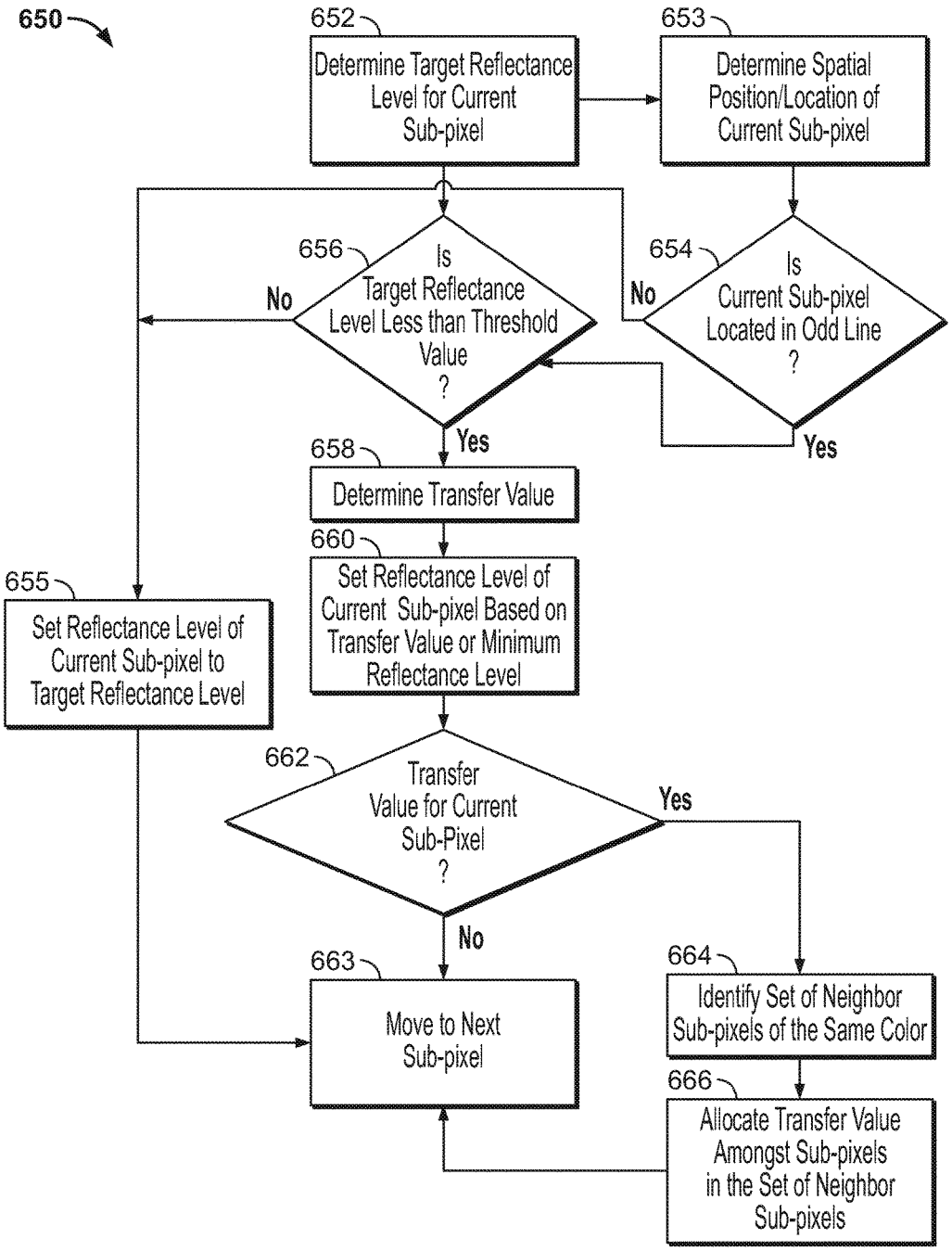
FIG. 12A is a flow chart depicting a method for redistributing reflectance levels from green sub-pixels in a display to other nearby sub-pixels of the same color.
Figure 12B:
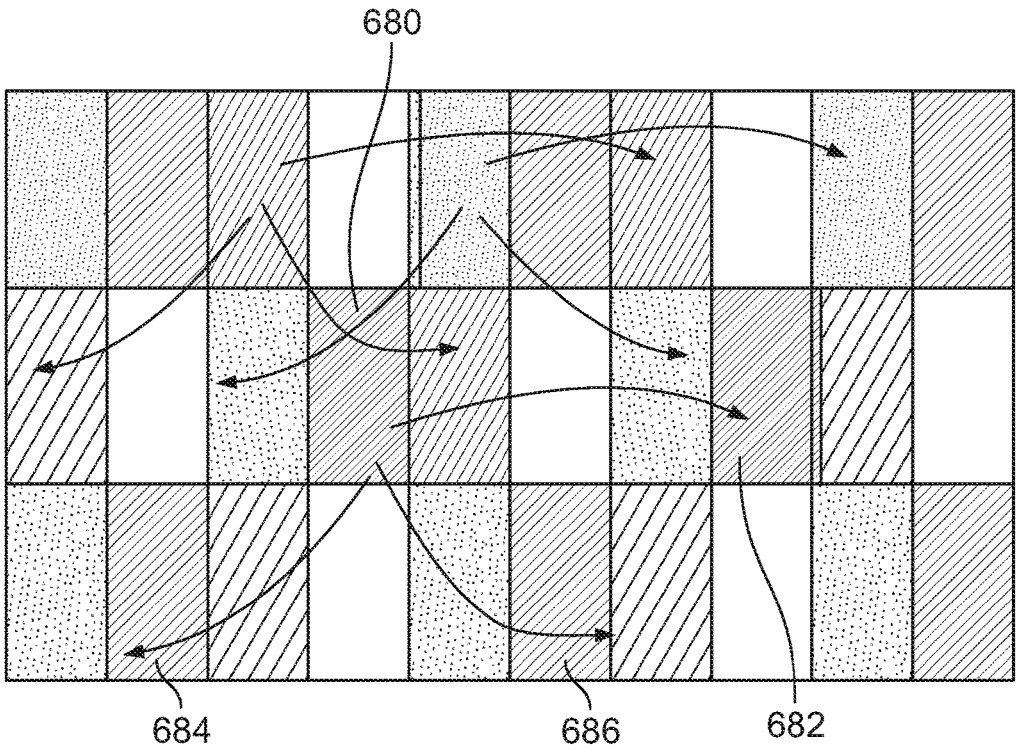
FIG. 12B depicts steps of the error diffusion method of FIG. 12A and shows a number of sub-pixels arranged in a pixel array of a display panel.

FIG. 12A is a flow chart depicting a method 650 for redistributing reflectance levels from green sub-pixels in a display to other nearby sub-pixels of the same color. FIG. 12B depicts steps of the mapping process of FIG. 12A and shows a number of sub-pixels arranged in a pixel array of a display panel (e.g., display panel 110). In one embodiment, method 650 is executed (e.g., by a display controller) against every green sub-pixel in the display device located in every other row of pixels. For example, method 650 may be executed against the green sub-pixels located in the even numbered rows of pixels in the display device (e.g., the second pixel row, fourth pixel row, sixth pixel row, etc.).

In order to prevent clipping of the green sub-pixels, in this example, during the mapping method, or a subsequent error diffusion method, as described with reference to FIGS. 8 and 9A, in step 651 a current green sub-pixel for processing and a set or a plurality of neighboring green sub-pixels to the current green sub-pixel being processed are identified. With reference to FIG. 12B, for example, the current green sub-pixel is identified as green sub-pixel 680 and the neighboring green sub-pixels may include a first green sub-pixel 682, a second green sub-pixel 684, and a third green sub-pixel 686. The set or plurality of neighboring green sub-pixels may be identified in any manner. For example, the set of neighboring green sub-pixels may include any number of green sub-pixels. The neighboring green sub-pixels may all occupy the same row within the display device (which may or may not include the green sub-pixel being processed) or may occupy two or more different rows of sub-pixels within the display device.

In step 652, a determination is made as to which green sub-pixel of the plurality of neighboring green sub-pixels, e.g., first green sub-pixel 682, second green sub-pixel 684, and third green sub-pixel 686, has the greatest target reflectance level and a maximum transfer value, e.g., a maximum value for a reflectance of the subject green sub-pixel 680 that can be transferred or distributed to the neighboring green sub-pixels without clipping, for the subject green sub-pixel is determined 653 based at least in part on the determination of the green sub-pixel having the greatest target reflectance level. In the example embodiment, if a target reflectance level of the first green sub-pixel is greater than or equal to a target reflectance level of the second green sub-pixel and the target reflectance level of the first green sub-pixel is greater than or equal to a target reflectance level of the third green sub-pixel, the maximum transfer value is equal to (1−the target reflectance level of the first green sub-pixel). If, alternatively, the target reflectance level of the second green sub-pixel is greater than or equal to the target reflectance level of the first green sub-pixel and the target reflectance level of the second green sub-pixel is greater than or equal to a target reflectance level of the third green sub-pixel, the maximum transfer value is equal to (1−the target reflectance level of the second green sub-pixel). If, alternatively, the target reflectance level of the third green sub-pixel is greater than or equal to a target reflectance level of the first green sub-pixel and the target reflectance level of the third green sub-pixel is greater than or equal to a target reflectance level of the second green sub-pixel, the maximum transfer value is equal to (1−the target reflectance level of the third green sub-pixel).

In step 653 a target reflectance level is determined for the current green sub-pixel being analyzed. With reference to FIG. 12B, the current green sub-pixel being analyzed is green sub-pixel 680. This may involve analyzing video or graphical data describing a source image that should be depicted by the display device. The target reflectance level may also be dependent upon a quantization error that may arise from the quantization of reflectance levels of previously-analyzed sub-pixels. In step 654, a spatial location of the current green sub-pixel being analyzed, e.g., current green sub-pixel 680. If, in step 654, it is determined that the current green sub-pixel being analyzed is in an even row of pixels in the display, in step 655 the reflectance level for the green sub-pixel being analyzed is set to the target reflectance level and method 650 moves to step 662 and can be re-executed for the next green sub-pixel.

If, however, in step 654, it is determined that the current green sub-pixel being analyzed is in an odd row of pixels in the display, in step 656, the target reflectance level is compared to a threshold reflectance level (e.g., Rth). If, in step 656, it is determined that the target reflectance level is greater than or equal to the threshold reflectance level, in step 655 the reflectance level for the green sub-pixel being analyzed is set to the target reflectance level and method 650 moves to step 662 and can be re-executed for the next green sub-pixel. Method 650 may then be repeated for the next green sub-pixel in the same row of pixels, or another green sub-pixel located within another row of pixels.

If, however, in step 656 it is determined that the target reflectance level is less than the threshold reflectance level, in step 658 a transfer value, i.e., a reflectance level error for the current green sub-pixel, is determined. In step 660, the reflectance level of the current green sub-pixel is set based on the determination of the transfer value in step 658. If there is no transfer value, the method moves on to the next green sub-pixel and may be repeated. If, however, in step 662 it is determined that a transfer value exists, that transfer value, i.e., the reflectance level error for the current green sub-pixel, is allocated amongst the green sub-pixels in the plurality of neighboring green sub-pixels.

In an alternative embodiment, if, in step 656 it is determined that the target reflectance level is less than the threshold reflectance level, the reflectance level of the current green sub-pixel is set to a minimum reflectance level (e.g., black). In step 662, a determination is made as to whether there is a reflectance level error for the green current sub-pixel. In this embodiment, the reflectance level error may be determined by calculating the difference between the target reflectance level for the current green sub-pixel and the minimum reflectance level. If there is no difference, then there is no reflectance level error to be allocated and the method moves onto the next green sub-pixel in step 663. If, however, there is a reflectance level error, that error is distributed across other green sub-pixels.

In step 664 a set or plurality of green neighboring sub-pixels are identified. With reference to FIG. 12B the neighboring green sub-pixels may include first green sub-pixel 682, second green sub-pixel 684 and third green sub-pixel 686, for example. Once identified, in step 666 the transfer value or the reflectance level error (i.e., the difference between the target reflectance level and the minimum reflectance level) is distributed amongst the set of neighboring green sub-pixels identified in step 664. When there are three sub-pixels in the set of neighboring green sub-pixels, the transfer value or reflectance level error may be divided by three, with the result being added to the target reflectance levels for each green sub-pixel in the set of neighboring green sub-pixels (e.g., first green sub-pixel 682, second sub-pixel 684 and third green sub-pixel 686). Similarly, the neighboring green sub-pixels may include only second green sub-pixel 684, and third green sub-pixel 686, for example, closest to green sub-pixel 680 and located in the next row of pixels in the display device. Once identified, in step 666 the transfer value or reflectance level error (i.e., the difference between the target reflectance level and the minimum reflectance level) is distributed amongst the set of neighboring green sub-pixels identified in step 664. When there are two green sub-pixels in the set of neighboring green sub-pixels, the reflectance level error may be divided by two, with the result being added to the target reflectance levels for each green sub-pixel in the set of neighboring green sub-pixels (e.g., second sub-pixel 682 and third green sub-pixel 684).

Although the method illustrated in FIG. 12A is described in terms of the processing of reflectance level data for green sub-pixels, it will be understood that the method could be applied to sub-pixels of other colors in a similar manner. For example, in one embodiment, the method may be utilized to analyze the target reflectance levels for each red sub-pixel in a first row of pixels of the display device. If the target reflectance levels are below a threshold level (e.g., Rth), the reflectance levels for those red sub-pixels are set to a minimum reflectance level. The resulting reflectance error is compensated for by increasing the target reflectance levels in the red sub-pixels in the next row of pixels of the display device. This approach can then be repeated for all red sub-pixels in particular rows of pixels in the display device. For example, the red sub-pixels in the display device's odd numbered pixel rows could be evaluated and driven to a minimum reflectance level when suitable, with the resulting reflectance error being diffused into the red sub-pixels in the display device's even rows of pixels. The method could similarly be applied to sub-pixels of other colors (e.g., blue or white sub-pixels).

In one embodiment, the method illustrated in FIG. 12A may be executed against each green sub-pixel located in the even (or, alternatively, odd) rows of pixels in the display device and also executed against the red and blue sub-pixels located in the odd (or, alternatively, even) rows of pixels in the display device. This process can result in a uniform distribution with high spatial frequencies for input sub-pixel intensities between half the quantization level and the quantization level. After the method of FIG. 12A has been executed, quantization and error diffusion methodologies, such as that illustrated in FIG. 8 may be utilized to perform reflectance level error diffusion throughout the sub-pixels of the display device. Additionally, in some embodiments, the white sub-pixel metamer mapping approach illustrated in FIG. 10 may also be executed in conjunction with (e.g., before, after, or during the execution of) the methods illustrated in FIG. 8 and FIG. 12A.

In example embodiment, an electrowetting display device includes a first support plate and a second support plate opposite to the first support plate. A pixel region is between the first support plate and the second support plate. The pixel region includes a data line and a gate line for controlling a state of a first red sub-pixel of a plurality of red sub-pixels of the electrowetting display device. The first red sub-pixel in a first pixel of a plurality of pixels of the electrowetting display device. A display controller includes an input line for receiving image data for a plurality of source image pixels from an external image source. The image data for a corresponding source image pixel of the plurality of source image pixels includes a brightness and color level for each of a red value, a green value and a blue value of a tuple representing the corresponding source image pixel. An output line provides at least one display signal level corresponding to a quantized reflectance level of the first red sub-pixel for applying a voltage to a first electrode of the first red sub-pixel to establish a driving voltage of the first red sub-pixel. The display controller is configured to determine a first target reflectance level of the first red sub-pixel based at least in part on the image data for a first source image pixel of the plurality of source image pixels, compare the first target reflectance level of the first red sub-pixel to a threshold reflectance level, determine that the first target reflectance level is less than or equal to the threshold reflectance level, set a reflectance level of the first red sub-pixel to the quantized reflectance level, wherein the quantized reflectance level is a minimum reflectance level or the threshold reflectance level, determine a reflectance quantization error by comparing the quantized reflectance level to the first target reflectance level, determine a second target reflectance level for a second red sub-pixel of a second pixel based at least in part on the image data for a second source image pixel of the plurality of source image pixels, the second pixel neighboring the first pixel in a first row of pixels of the plurality of pixels, set a second reflectance level of the second red sub-pixel to the second target reflectance level plus a first fraction of the reflectance quantization error, determine a third target reflectance level for a third red sub-pixel of a third pixel based at least in part on the image data for a third source image pixel of the plurality of source image pixels, the third pixel neighboring the first pixel, the third pixel in a second row of pixels of the plurality of pixels under the first row of pixels, set a third reflectance level of the third red sub-pixel to the third target reflectance level plus a second fraction of the reflectance quantization error, determine a fourth target reflectance level for a fourth red sub-pixel of a fourth pixel based at least in part on the image data for a fourth source image pixel of the plurality of source image pixels, the fourth pixel neighboring the first pixel, the fourth pixel in the second row of pixels, and set a fourth reflectance level of the fourth red sub-pixel to the fourth target reflectance level plus a third fraction of the reflectance quantization error.

The display controller may be configured to determine a reflectance quantization error by calculating a difference between the first target reflectance level and the quantized reflectance value. The display controller may also be configured to determine the first target reflectance level based in part on a reflectance quantization error from a quantization of reflectance levels of a previously-analyzed red sub-pixel of the plurality of red sub-pixels. The display controller may be configured to, before comparing the first target reflectance level of the first red sub-pixel to the threshold reflectance level, determine a fifth target reflectance level of a white sub-pixel in the first pixel based on the image data for the first source image pixel, compare the fifth target reflectance level of the white sub-pixel to the threshold reflectance level, determine that the fifth target reflectance level of the white sub-pixel is less than the threshold reflectance level, set a reflectance level of the white sub-pixel to the minimum reflectance level; and distribute a portion of a reflectance of the white sub-pixel to each of a plurality of neighboring, non-white sub-pixels.

In another example embodiment, a method of driving an electrowetting display device including a plurality of sub-pixels, includes setting a first reflectance level of a first sub-pixel in the plurality of sub-pixels to a minimum reflectance level or a threshold reflectance level, A reflectance quantization error is determined by comparing the first reflectance level of the first sub-pixel to a first target reflectance level of the first sub-pixel. The first target reflectance level of the first sub-pixel is based at least in part on image data for a first source image pixel of a plurality of source image pixels. A second reflectance level of a second sub-pixel in the plurality of sub-pixels is set to a second target reflectance level of the second sub-pixel based at least in part on image data for a second source image pixel of the plurality of source image pixels plus a first fraction of the reflectance quantization error. A third reflectance level of a third sub-pixel in the plurality of sub-pixels is set to a third target reflectance level of the third sub-pixel based at least in part on image data for a third source image pixel of the plurality of source image pixels plus a second fraction of the reflectance quantization error. A fourth reflectance level of a fourth sub-pixel in the plurality of sub-pixels is set to a fourth target reflectance level of the fourth sub-pixel based at least in part on image data for a fourth source image pixel of the plurality of source image pixels plus a third fraction of the reflectance quantization error. In one embodiment, the first sub-pixel is in a first pixel of the electrowetting display device and the second sub-pixel is in a second pixel of the electrowetting display device, and the first fraction is determined to be ½. The first pixel and the second pixel may be determined to be in a same row of pixels in the electrowetting display device. In one embodiment, third sub-pixel is associated with a third pixel of the electrowetting display device and the fourth sub-pixel is associated with a fourth pixel of the electrowetting display device, and the second fraction is determined to be ¼ and third fraction is determined to be ¼. In one embodiment, the third pixel and the fourth pixel are determined to be in a same row of pixels in the electrowetting display device. Before setting a reflectance level of a first sub-pixel in the plurality of sub-pixels to a minimum reflectance level or a threshold reflectance level, identifying a white sub-pixel adjacent to the first sub-pixel is identified, a fifth target reflectance level of the white sub-pixel is determined, the fifth target reflectance level of the white sub-pixel is compared to the threshold reflectance level, the fifth target reflectance level of the white sub-pixel is determined to be less than the threshold reflectance level, a metamer transfer value is determined based at least in part on the fifth target reflectance, a reflectance level of the white sub-pixel is set based on the determination of the metamer transfer value, and the metamer transfer value is distributed to each sub-pixel of a set of sub-pixels neighboring the white sub-pixel. In one embodiment, determining a metamer transfer value includes identifying, in the plurality of sub-pixels, the set of sub-pixels neighboring the white sub-pixel. A first sub-pixel of the set of sub-pixels neighboring the white sub-pixel having a greatest target reflectance level is determined, wherein the first sub-pixel has a first target reflectance level greater than or equal to a second target reflectance level of a second sub-pixel of the set of sub-pixels neighboring the white sub-pixel and the first target reflectance level is greater than or equal to a third target reflectance level of a third sub-pixel of the set of sub-pixels neighboring the white sub-pixel. A maximum metamer transfer value equal to (1−the first target reflectance level) is set. A target reflectance level of the first sub-pixel is determined. The target reflectance level of the first sub-pixel is based at least in part on image data for a first source image pixel of a plurality of source image pixels. A reflectance level of the first sub-pixel is set to the target reflectance level of the first sub-pixel plus the metamer transfer value and the reflectance level of the white sub-pixel is set to the target reflectance level of white sub-pixel minus the metamer transfer value. In a particular embodiment, it is determined that each sub-pixel in the set of sub-pixels is associated with a first pixel containing the white sub-pixel or a second pixel adjacent to the first pixel. Setting a first reflectance level of a first sub-pixel in the plurality of sub-pixels to a minimum reflectance level or a threshold reflectance level may include determining the first sub-pixel is in an open state, determining the first target reflectance level of the first sub-pixel is less than the threshold reflectance level, and setting the first reflectance level of the first sub-pixel to the threshold reflectance level. Setting a first reflectance level of a first sub-pixel in the plurality of sub-pixels to a minimum reflectance level or a threshold reflectance level may include determining the first sub-pixel is in a closed state, determining the first target reflectance level of the first sub-pixel is less than the threshold reflectance level, and setting the first reflectance level of the first sub-pixel to the minimum reflectance level.

In another example embodiment, a method of driving an electrowetting display device including a plurality of sub-pixels, includes identify, in the plurality of sub-pixels, a white sub-pixel and a plurality of neighboring sub-pixels to the white sub-pixel. The white sub-pixel is in a first pixel of the electrowetting display device. A first sub-pixel of the plurality of neighboring sub-pixels is determined to have a greatest target reflectance level. A maximum metamer transfer value is determined based at least in part on the determination of the first sub-pixel having the greatest target reflectance level. A determination is made that a target reflectance level for the white sub-pixel is less than a threshold reflectance level. A metamer transfer value is determined for the white sub-pixel. A reflectance level of the white sub-pixel is set based on the determination of the metamer transfer value. The metamer transfer value is distributed to each sub-pixel of the plurality of neighboring sub-pixels.

In one embodiment, a reflectance level for the first sub-pixel is set equal to a target reflectance level of the first sub-pixel plus the metamer transfer value and a reflectance level for a second sub-pixel of the plurality of neighboring sub-pixels is set equal to a target reflectance level of the second sub-pixel plus the metamer transfer value. In one embodiment, setting a reflectance level of the white sub-pixel based on the determination of the metamer transfer value includes setting the reflectance level of the white sub-pixel to the target reflectance level of the white sub-pixel minus the metamer transfer value. In one embodiment, determining that a first sub-pixel of the plurality of sub-pixels neighboring the white sub-pixel has a greatest target reflectance level includes determining that the first sub-pixel has a first target reflectance level greater than or equal to a second target reflectance level of a second sub-pixel of the plurality of sub-pixels and the first target reflectance level is greater than or equal to a third target reflectance level of a third sub-pixel of the plurality of sub-pixels.

Determining a maximum metamer transfer value may include determining that the maximum metamer transfer value is equal to (1−the first target reflectance level). The metamer transfer value may be distributed to each of the first sub-pixel, a second sub-pixel, and a third sub-pixel. A reflectance level of the first sub-pixel is set to a target reflectance level of the first sub-pixel plus the metamer transfer value. A reflectance level of the second sub-pixel is set to a target reflectance level of the second sub-pixel plus the metamer transfer value. A reflectance level of the third sub-pixel is set to a target reflectance level of the third sub-pixel plus the metamer transfer value. The reflectance level of the white sub-pixel is set to the target reflectance level of white sub-pixel minus the metamer transfer value.

Figure 13:
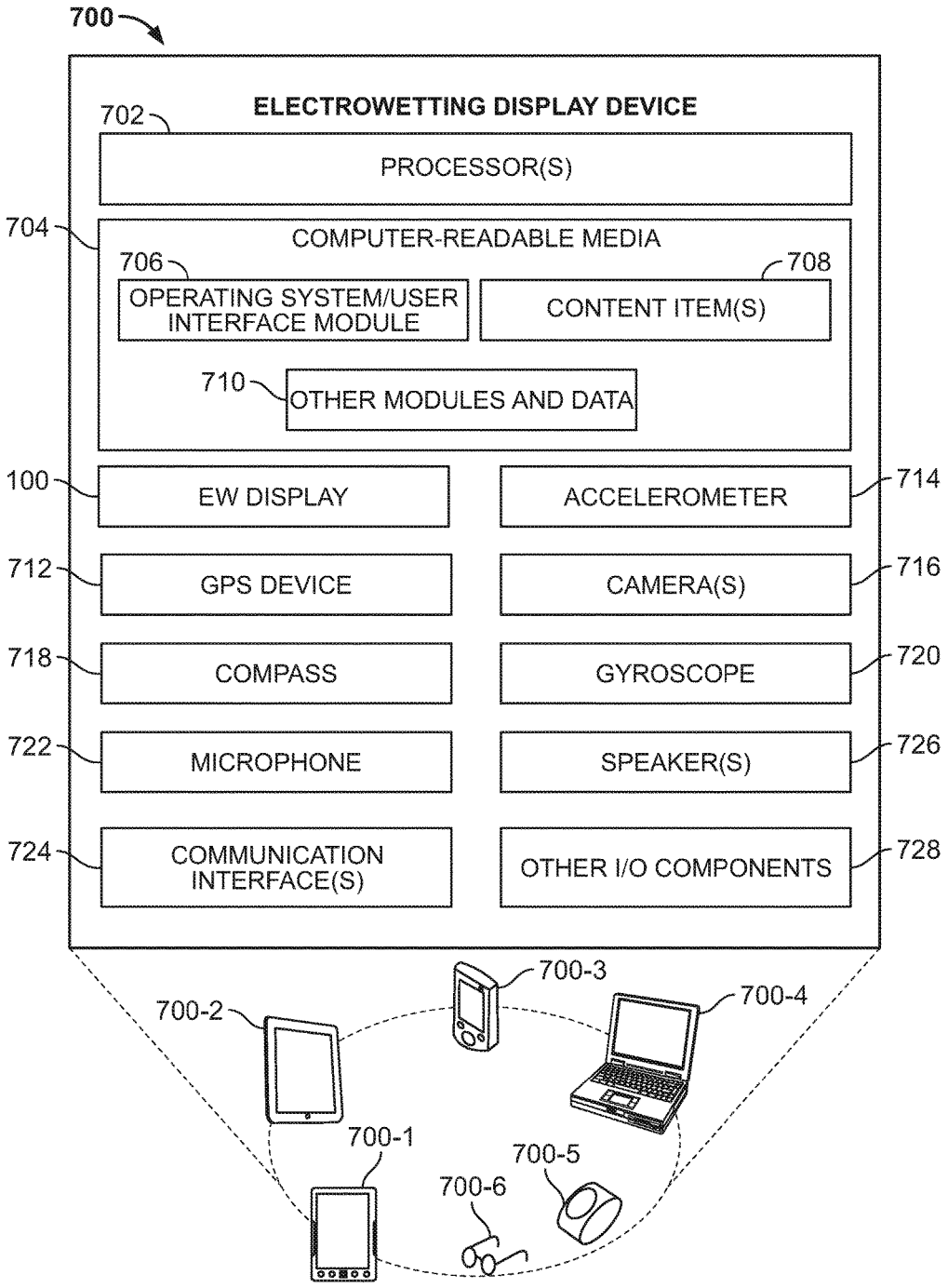
FIG. 13 illustrates example electrowetting display devices that may incorporate an electrowetting display, according to various embodiments.

FIG. 13 illustrates select example components of an example electronic device, e.g., an electrowetting display device 700, according to some implementations. In alternative embodiments, the electronic device may include other suitable displays. Such types of displays include, but are not limited to, LCDs, cholesteric displays, electrophoretic displays, electrofluidic pixel displays, photonic ink displays, and the like.

Electrowetting display device 700 may be implemented as any of a number of different types of electronic devices. Some examples of electrowetting display device 700 may include digital media devices and eBook readers 700-1; tablet computing devices 700-2; smart phones, mobile devices and portable gaming systems 700-3; laptop and netbook computing devices 700-4; wearable computing devices 700-5; augmented reality devices, helmets, goggles or glasses 700-6; and any other device capable of connecting with electrowetting display device 100 and including a processor and memory for controlling the display according to the techniques described herein.

In a very basic configuration, electrowetting display device 700 includes, or accesses, components such as at least one control logic circuit, central processing unit, or processor 702, and one or more computer-readable media 704. Each processor 702 may itself include one or more processors or processing cores. For example, processor 702 can be implemented as one or more microprocessors, microcomputers, microcontrollers, digital signal processors, central processing units, state machines, logic circuitries, and/or any devices that manipulate signals based on operational instructions. In some cases, processor 702 may be one or more hardware processors and/or logic circuits of any suitable type specifically programmed or configured to execute the algorithms and processes described herein. Processor 702 can be configured to fetch and execute computer-readable instructions stored in computer-readable media 704 or other computer-readable media. Processor 702 can perform one or more of the functions attributed to timing controller 102, gate driver 104, and/or source driver 106 of electrowetting display device 100. Processor 702 can also perform one or more functions attributed to a graphic controller (not shown in FIG. 7) for the electrowetting display device.

Depending on the configuration of electrowetting display device 700, computer-readable media 704 may be an example of tangible non-transitory computer storage media and may include volatile and nonvolatile memory and/or removable and non-removable media implemented in any type of technology for storage of information such as computer-readable instructions, data structures, program modules or other data. Computer-readable media 704 may include, without limitation, RAM, ROM, EEPROM, flash memory or other computer readable media technology, CD-ROM, digital versatile disks (DVD) or other optical storage, magnetic cassettes, magnetic tape, solid-state storage and/or magnetic disk storage. Further, in some embodiments, electrowetting display device 700 may access external storage, such as RAID storage systems, storage arrays, network attached storage, storage area networks, cloud storage, or any other medium that can be used to store information and that can be accessed by processor 702 directly or through another computing device or network. Accordingly, computer-readable media 704 may be computer storage media able to store instructions, modules or components that may be executed by processor 702.

Computer-readable media 704 may be used to store and maintain any number of functional components that are executable by processor 702. In some implementations, these functional components comprise instructions or programs that are executable by processor 702 and that, when executed, implement operational logic for performing the actions attributed above to electrowetting display device 700. Functional components of electrowetting display device 700 stored in computer-readable media 704 may include the operating system and user interface module 706 for controlling and managing various functions of electrowetting display device 700, and for generating one or more user interfaces on electrowetting display device 100 of electrowetting display device 700.

In addition, computer-readable media 704 may also store data, data structures and the like, that are used by the functional components. For example, data stored by computer-readable media 704 may include user information and, optionally, one or more content items 708. Depending on the type of electrowetting display device 700, computer-readable media 704 may also optionally include other functional components and data, such as other modules and data 710, which may include programs, drivers and so forth, and the data used by the functional components. Further, electrowetting display device 700 may include many other logical, programmatic and physical components, of which those described are merely examples that are related to the discussion herein. Further, while the figures illustrate the functional components and data of electrowetting display device 700 as being present on electrowetting display device 700 and executed by processor 702 on electrowetting display device 700, it is to be appreciated that these components and/or data may be distributed across different computing devices and locations in any manner.

FIG. 7 further illustrates examples of other components that may be included in electrowetting display device 700. Such examples include various types of sensors, which may include a GPS device 712, an accelerometer 714, one or more cameras 716, a compass 718, a gyroscope 720, and/or a microphone 722. Electrowetting display device 700 may further include one or more communication interfaces 724, which may support both wired and wireless connection to various networks, such as cellular networks, radio, Wi-Fi networks, close-range wireless connections, near-field connections, infrared signals, local area networks, wide area networks, the Internet, and so forth. Communication interfaces 724 may further allow a user to access storage on or through another device, such as a remote computing device, a network attached storage device, cloud storage, or the like.

Electrowetting display device 700 may further be equipped with one or more speakers 726 and various other input/output (I/O) components 728. Such I/O components 728 may include a touchscreen and various user controls (e.g., buttons, a joystick, a keyboard, a keypad, etc.), a haptic or tactile output device, connection ports, physical condition sensors, and so forth. For example, operating system 706 of electrowetting display device 700 may include suitable drivers configured to accept input from a keypad, keyboard, or other user controls and devices included as I/O components 728. Additionally, electrowetting display device 700 may include various other components that are not shown, examples of which include removable storage, a power source, such as a battery and power control unit, a PC Card component, and so forth.

Various instructions, methods and techniques described herein may be considered in the general context of computer-executable instructions, such as program modules stored on computer storage media and executed by the processors herein. Generally, program modules include routines, programs, objects, components, data structures, etc., for performing particular tasks or implementing particular abstract data types. These program modules, and the like, may be executed as native code or may be downloaded and executed, such as in a virtual machine or other just-in-time compilation execution environment. Typically, the functionality of the program modules may be combined or distributed as desired in various implementations. An implementation of these modules and techniques may be stored on computer storage media or transmitted across some form of communication. In some embodiments, a display device as described herein may comprise a portion of a system that includes one or more processors and one or more computer memories, which may reside on a control board, for example. Display software may be stored on the one or more memories and may be operable with the one or more processors to modulate light that is received from an outside source (e.g., ambient room light) or out-coupled from a lightguide of the display device. For example, display software may include code executable by a processor to modulate optical properties of individual pixels of the electrowetting display based, at least in part, on electronic signals representative of image and/or video data. The code may cause the processor to modulate the optical properties of pixels by controlling electrical signals (e.g., voltages, currents, and fields) on, over, and/or in layers of the electrowetting display.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments disclosed, but that such claimed subject matter may also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter may be practiced without these specific details. In other instances, methods, apparatuses, or systems that would be known by one of ordinary skill have not been described in detail so as not to obscure claimed subject matter.

Reference throughout this specification to "one embodiment" or "an embodiment" may mean that a particular feature, structure, or characteristic described in connection with a particular embodiment may be included in at least one embodiment of claimed subject matter. Thus, appearances of the phrase "in one embodiment" or "an embodiment" in various places throughout this specification is not necessarily intended to refer to the same embodiment or to any one particular embodiment described. Furthermore, it is to be understood that particular features, structures, or characteristics described may be combined in various ways in one or more embodiments. In general, of course, these and other issues may vary with the particular context of usage. Therefore, the particular context of the description or the usage of these terms may provide helpful guidance regarding inferences to be drawn for that context.

What is claimed is:

1. A method of driving an electrowetting display device including a plurality of sub-pixels, the method comprising:

determining a first sub-pixel of the plurality of sub-pixels is in an open state and a first target reflectance level of the first sub-pixel is less than a threshold reflectance level;

setting a first reflectance level of the first sub-pixel in the plurality of sub-pixels to a threshold reflectance level;

determining the first sub-pixel of the plurality of sub-pixels is in a closed state and the first target reflectance level of the first sub-pixel is less than the threshold reflectance level;

setting the first reflectance level of the first sub-pixel to a minimum reflectance level;

determining a reflectance quantization error by comparing the first reflectance level of the first sub-pixel to the first target reflectance level of the first sub-pixel, the first target reflectance level of the first sub-pixel based at least in part on image data for a first source image pixel of a plurality of source image pixels;

setting a second reflectance level of a second sub-pixel in the plurality of sub-pixels to a second target reflectance level of the second sub-pixel based at least in part on image data for a second source image pixel of the plurality of source image pixels plus a first fraction of the reflectance quantization error;

setting a third reflectance level of a third sub-pixel in the plurality of sub-pixels to a third target reflectance level of the third sub-pixel based at least in part on image data for a third source image pixel of the plurality of source image pixels plus a second fraction of the reflectance quantization error; and setting a fourth reflectance level of a fourth sub-pixel in the plurality of sub-pixels to a fourth target reflectance level of the fourth sub-pixel based at least in part on image data for a fourth source image pixel of the plurality of source image pixels plus a third fraction of the reflectance quantization error.

2. The method of claim 1, wherein the first sub-pixel is in a first pixel of the electrowetting display device and the second sub-pixel is in a second pixel of the electrowetting display device, the method further comprising determining the first fraction is ½.

3. The method of claim 2, further comprising determining the first pixel and the second pixel are in a same row of pixels in the electrowetting display device.

4. The method of claim 2, wherein the third sub-pixel is associated with a third pixel of the electrowetting display device and the fourth sub-pixel is associated with a fourth pixel of the electrowetting display device, the method further comprising:

determining the second fraction is ¼; and determining the third fraction is ¼.

5. The method of claim 4, further comprising determining the third pixel and the fourth pixel are in a same row of pixels in the electrowetting display device.

6. The method of claim 1, further comprising, before setting a reflectance level of a first sub-pixel in the plurality of sub-pixels to a minimum reflectance level or a threshold reflectance level:

identifying a white sub-pixel adjacent to the first sub-pixel;

determining a fifth target reflectance level of the white sub-pixel;

comparing the fifth target reflectance level of the white sub-pixel to the threshold reflectance level;

determining that the fifth target reflectance level of the white sub-pixel is less than the threshold reflectance level;

determining a metamer transfer value based at least in part on the fifth target reflectance;

setting a reflectance level of the white sub-pixel based on the determination of the metamer transfer value; and distributing the metamer transfer value to each sub-pixel of a set of sub-pixels neighboring the white sub-pixel.

7. The method of claim 6, wherein determining a metamer transfer value further comprises:

identifying, in the plurality of sub-pixels, the set of sub-pixels neighboring the white sub-pixel;

determining a first sub-pixel of the set of sub-pixels neighboring the white sub-pixel having a greatest target reflectance level, wherein the first sub-pixel has a first target reflectance level greater than or equal to a second target reflectance level of a second sub-pixel of the set of sub-pixels neighboring the white sub-pixel and the first target reflectance level is greater than or equal to a third target reflectance level of a third sub-pixel of the set of sub-pixels neighboring the white sub-pixel; and setting a maximum metamer transfer value equal to (1—the first target reflectance level).

8. The method of claim 7, further comprising:

determining a target reflectance level of the first sub-pixel, the target reflectance level of the first sub-pixel based at least in part on image data for a first source image pixel of a plurality of source image pixels;

setting a reflectance level of the first sub-pixel to the target reflectance level of the first sub-pixel plus the metamer transfer value; and setting the reflectance level of the white sub-pixel to a target reflectance level of the white sub-pixel minus the metamer transfer value.

9. The method of claim 8, further comprising determining each sub-pixel in the set of sub-pixels is associated with a first pixel containing the white sub-pixel or a second pixel adjacent to the first pixel.

10. A method of driving an electrowetting display device including a plurality of sub-pixels, the method comprising:

determining a first sub-pixel of the plurality of sub-pixels is in an open state and a first target reflectance level of the first sub-pixel is less than a threshold reflectance level;

setting a first reflectance level of the first sub-pixel in the plurality of sub-pixels to a threshold reflectance level;

determining the first sub-pixel of the plurality of sub-pixels is in a closed state and the first target reflectance level of the first sub-pixel is less than the threshold reflectance level;

setting the first reflectance level of the first sub-pixel to a minimum reflectance level;

determining a reflectance quantization error by comparing the first reflectance level of the first sub-pixel to a first target reflectance level of the first sub-pixel, the first target reflectance level of the first sub-pixel based at least in part on image data for a first source image pixel of a plurality of source image pixels; and setting a second reflectance level of a second sub-pixel in the plurality of sub-pixels to a second target reflectance level of the second sub-pixel based at least in part on image data for a second source image pixel of the plurality of source image pixels plus a first fraction of the reflectance quantization error.

11. The method of claim 10, wherein the first sub-pixel is in a first pixel of the electrowetting display device and the second sub-pixel is in a second pixel of the electrowetting display device, the method further comprising determining the first fraction is ½.

12. The method of claim 10, further comprising determining the first pixel and the second pixel are in a same row of pixels in the electrowetting display device.

13. The method of claim 10, further comprising:

setting a third reflectance level of a third sub-pixel in the plurality of sub-pixels to a third target reflectance level of the third sub-pixel based at least in part on image data for a third source image pixel of the plurality of source image pixels plus a second fraction of the reflectance quantization error; and setting a fourth reflectance level of a fourth sub-pixel in the plurality of sub-pixels to a fourth target reflectance level of the fourth sub-pixel based at least in part on image data for a fourth source image pixel of the plurality of source image pixels plus a third fraction of the reflectance quantization error.

14. The method of claim 13, wherein the third sub-pixel is associated with a third pixel of the electrowetting display device and the fourth sub-pixel is associated with a fourth pixel of the electrowetting display device, the method further comprising:

determining the second fraction is ¼; and determining the third fraction is ¼.

15. An electrowetting display device, comprising:

a first support plate and a second support plate opposite the first support plate;

a pixel region between the first support plate and the second support plate, the pixel region including a data line and a gate line for controlling a state of a first sub-pixel of a plurality of sub-pixels of the electrowetting display device; and a display controller configured to:

determine the first sub-pixel of the plurality of sub-pixels is in an open state and a first target reflectance level of the first sub-pixel is less than a threshold reflectance level;

set a first reflectance level of the first sub-pixel in the plurality of sub-pixels to a threshold reflectance level;

determine the first sub-pixel of the plurality of sub-pixels is in a closed state and the first target reflectance level of the first sub-pixel is less than the threshold reflectance level;

set the first reflectance level of the first sub-pixel to a minimum reflectance level;

determine a reflectance quantization error by comparing the first reflectance level of the first sub-pixel to the first target reflectance level of the first sub-pixel, the first target reflectance level of the first sub-pixel based at least in part on image data for a first source image pixel of a plurality of source image pixels;

set a second reflectance level of a second sub-pixel in the plurality of sub-pixels to a second target reflectance level of the second sub-pixel based at least in part on image data for a second source image pixel of the plurality of source image pixels plus a first fraction of the reflectance quantization error;

set a third reflectance level of a third sub-pixel in the plurality of sub-pixels to a third target reflectance level of the third sub-pixel based at least in part on image data for a third source image pixel of the plurality of source image pixels plus a second fraction of the reflectance quantization error; and set a fourth reflectance level of a fourth sub-pixel in the plurality of sub-pixels to a fourth target reflectance level of the fourth sub-pixel based at least in part on image data for a fourth source image pixel of the plurality of source image pixels plus a third fraction of the reflectance quantization error.

16. The electrowetting display device of claim 15, wherein the first sub-pixel is in a first pixel of the electrowetting display device and the second sub-pixel is in a second pixel of the electrowetting display device, and the first fraction is ½.

17. The electrowetting display device of claim 16, wherein the display controller is further configured to:

determine the first pixel and the second pixel are in a same row of pixels in the electrowetting display device.

18. The electrowetting display device of claim 16, wherein the third sub-pixel is associated with a third pixel of the electrowetting display device and the fourth sub-pixel is associated with a fourth pixel of the electrowetting display device; and wherein the display controller is further configured to:

determine the second fraction is ¼; and determine the third fraction is ¼.

* * * * *